US006846069B2

(12) United States Patent
Ito et al.

(10) Patent No.: US 6,846,069 B2
(45) Date of Patent: Jan. 25, 2005

(54) INK-JET HEAD

(75) Inventors: Atsushi Ito, Nagoya (JP); Yasuhiro Sekiguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 77 days.

(21) Appl. No.: 10/431,389

(22) Filed: May 8, 2003

(65) Prior Publication Data

US 2003/0210307 A1 Nov. 13, 2003

(30) Foreign Application Priority Data

May 10, 2002 (JP) ..... 2002-135506
May 13, 2002 (JP) ..... 2002-137142
Nov. 22, 2002 (JP) ..... 2002-339027

(51) Int. Cl.[7] ..... B41J 2/045
(52) U.S. Cl. ..... 347/71
(58) Field of Search ..... 347/54, 65, 68, 347/70, 71

(56) References Cited

U.S. PATENT DOCUMENTS 5,087,930 A * 2/1992 Roy et al. ..... 347/85
5,402,159 A 3/1995 Takahashi et al.
5,752,303 A 5/1998 Thiel
5,790,155 A * 8/1998 Usui et al. ..... 347/68
6,033,058 A * 3/2000 Usui et al. ..... 347/71
6,260,963 B1 7/2001 Reistad et al.
6,290,340 B1 * 9/2001 Kitahara et al. ..... 347/70
6,457,818 B1 * 10/2002 Kurashima et al. ..... 347/71
2001/0020968 A1 9/2001 Isono et al.
2002/0024567 A1 2/2002 Takagi

FOREIGN PATENT DOCUMENTS

EP 0 895 863 A2 2/1999
EP 0 985 534 A1 3/2000
EP 1 136 270 A2 9/2001
JP A 4-341853 11/1992
JP A-8-48030 2/1996
JP A 8-58089 3/1996
JP A 2001-246744 9/2001

* cited by examiner

*Primary Examiner*—Anh T. N. Vo
(74) *Attorney, Agent, or Firm*—Oliff & Berridge, PLC

(57) ABSTRACT

An ink-jet head of the present invention comprising a plurality of ink ejecting nozzles; a first flat plate forming therein a plurality of pressure chambers communicating with their respective nozzles; a second flat plate forming therein a common ink chamber to distribute and feed the ink to the pressure chambers; and a third flat plate interposed between the first flat plate and the second flat plate and forming therein a restricted passage to restrict an ink flow, one end of which is connected to the pressure chamber and the other end of which is connected to the common ink chamber. The restricted passage is formed in the third flat plate, to be elongated along a direction of a surface of the third flat plate and is extended in a direction parallel with a plane formed by the pressure chambers.

50 Claims, 21 Drawing Sheets

INK-JET HEAD

BACKGROUND OF THE INVENTION

1. Field of the Invention

The present invention relates to a construction of an ink-jet head for squirting ink droplets at a print surface to form an image thereon.

2. Description of the Related Art

Ink-jet recording equipment, such as an ink-jet printer, is equipped with an ink-jet head. In general, the ink-jet head comprises a plurality of nozzles to squirting ink at a print surface, a plurality of pressure chambers arranged in correspondence to the nozzles, and a common ink chamber to distribute the ink and feed it to the plurality of pressure chambers. Some ink-jet heads are structured so that the pressure chambers and the common ink chamber are formed in an interior of the ink-jet head, for the purpose of downsizing the ink-jet head.

In the known ink-jet heads, the common ink chamber is connected to an ink supply source such as an ink cartridge through an ink feed port opening in an outer surface of the ink-jet head.

In the construction of the ink-jet heads mentioned above, the ink fed from the ink supply source to the common ink chamber is distributed and supplied to the respective pressure chambers. Each pressure chamber is provided with an actuator comprising e.g. a piezoelectric element, so that the ink is energized by the drive of the actuator and is squirted from the nozzles to a print surface to form a desired image thereon.

In general, the method of laminating a multiple of thin flat plates, each having the pressure chambers and the common chamber previously formed by etching is widely adopted to form an ink passage including the pressure chambers and the common ink chamber in the interior of the ink-jet head.

Some of the known ink-jet heads have a restricted passage to restrict the pressure orienting toward the common chamber so that the pressure exerted on the ink in the pressure chamber by the drive of the actuator can be effectively oriented toward the nozzles to increase a speed of the ink squirting from the nozzles. The restricted passage is formed in such a way that its cross-sectional area is made smaller than a cross-sectional area of the pressure chamber to provide a passage resistance against a back-flow of the ink from the pressure chambers to the common ink chamber.

In the conventional ink-jet head, the restricted passage is additionally formed by half etching or equivalent in the flat plate in which the pressure chambers are previously formed. Also, the restricted passage is extended in a longitudinal direction of the pressure chamber. This construction requires that the flat plate should have at least a width corresponding to a length of the pressure chamber plus a length of the restricted passage, for forming the pressure chambers and the restricted passage in the flat plate. This makes it hard to meet the demands for realization of a compact ink-jet head with a high-integration and high-density passage arrangement accompanied by the needs of a high resolution of a picture.

Also, the pressure chambers and the restricted passage are both the parts for which high dimensional precision is required in the ink-jet head. Forming the both in the same flat plate means that a complicated configuration for which high dimensional precision is strictly required is formed in a flat plate and thus accompanies difficulties in production. This contributes to reduction in yield and increase in production cost.

Further, when the restricted passage is formed in a grooved shape in the flat plate by using the half etching technique, the half etching depth must be controlled with strict precision to produce a required passage resistance with high precision. This also contributes to reduction in yield and increase in production cost.

Some known ink-jet heads are constructed so that the restricted passage is formed to let the ink to flow in the thickness direction of the flat plate. With this construction, as a result of the length of the restricted passage being limited to the plate thickness at the maximum, the restricted passage is shortened too much for the restricted passage to provide sufficient resistance against the back-flow of the ink trying to flow back to the common ink chamber from the pressure chamber side. This produces the problem of decrease in a speed of the ink squirting from the nozzles.

Further, the ink-jet head of the flat-plate laminated structure makes it easy to form some stepped portions in the ink passage formed in an interior of the ink-jet head, so that stagnation of the ink is apt to occur at those stepped portions and bubbles are apt to grow thereat. This prevents a smooth ink flow and eventually causes the trouble that the ink squirting failure (missing dot) is often produced. Although the technique of using a purge mechanism, built in the ink-jet recording device, to forcibly suck the ink bubbles from the nozzles is also known, since it is hard to purge the bubbles from the locations where the stagnation of the ink occurs, even the purge mechanism often has difficulties in purging the bubbles.

SUMMARY OF THE INVENTION

It is an object of the present invention to provide an ink-jet head highly compact in size and easy to manufacture, having an ink passage extending from the common ink chambers to the pressure chambers through the restricted passage.

It is another object of the present invention to provide an ink-jet head that can provide sufficient resistance against a back-flow of the ink trying to flow back to the common ink chambers from the pressure chambers at the drive of the actuators, to increase a speed of the ink squirting from the nozzles.

It is a further object of the present invention to provide an ink-jet head that can provide a passage structure to allow the ink to flow smoothly through it without stagnation, to provide an excellent performance in discharging bubbles formed in the interior of the ink-jet head.

In accordance with the first aspect of the present invention, there is provided an ink-jet head comprising a plurality of ink ejecting nozzles; a first flat plate forming therein a plurality of pressure chambers communicating with their respective nozzles; a second flat plate forming therein a common ink chamber to distribute and feed the ink to the pressure chambers; and a third flat plate interposed between the first flat plate and the second flat plate and forming therein a restricted passage to restrict an ink flow, one end of which is connected to the pressure chamber and the other end of which is connected to the common ink chamber, wherein the restricted passage is formed in the third flat plate, to be elongated along a direction of a surface of the third flat plate and is extended in a direction parallel with a plane formed by the pressure chambers.

With this construction, since the restricted passage and the pressure chamber are formed in different flat plates, respectively (e.g. the restricted passage is formed in the third flat plate and the pressure plate is formed in the first plate), the interference between the pressure chamber and the restricted passage can be avoided when the ink passage is arranged. This can provide an improved degree of freedom for arrangement of the pressure chamber and the restricted passage. Also, since the restricted passage is formed to be oriented to a direction parallel with the plane formed by the plurality of pressure chambers, the space required for the passages can be kept at a minimal increase with respect to the laminating direction of the flat plates. This can facilitate improvement in integration of the ink passage, and as such can meet the demands for realization of a high-density nozzle arrangement accompanied by the demands for a compact ink-jet head and a high resolution of a picture. In addition, by forming the pressure chamber and the restricted passage in the different flat plates, respectively, the problem that both of them must be fabricated with high precision can be avoided and thus the production cost can be reduced.

In accordance with the second aspect of the present invention, there is provided an ink-jet head comprising a plurality of ink ejecting nozzles; a plurality of pressure chambers communicating with their respective nozzles; a common ink chamber to distribute and feed the ink to the pressure chambers; and an ink passage extending from the common ink chamber to the nozzle through the pressure chamber, wherein the ink passage comprises a first elongated passage, and a second passage positioned upstream of the first passage and connected to one lengthwise end portion of the first passage at an angle smaller than 90°.

This can provide the construction to urge the ink in the second passage to flow toward the end wall of the first passage at the connecting portion of the end of the first passage to the second passage, though the stagnation of ink flow is likely to occur and air bubbles accumulate easily at that connecting portion. This can prevent the generation of the stagnation at the location near the end wall and can also purge the air bubbles at that location easily, thus providing improved bubble purging properties.

In accordance with the third aspect of the present invention, there is provided an ink-jet head comprising a plurality of ink ejecting nozzles; a plurality of pressure chambers communicating with their respective nozzles; a common ink chamber to distribute and feed the ink to the pressure chambers; and an ink passage extending from the common ink chamber to the nozzle through the pressure chamber, wherein the ink passage comprises a communicating passage opening to an upstream end of the pressure chamber; and a restricted passage extending in parallel with a direction of an ink flow in the pressure chamber, with one end thereof connected to the pressure chamber via the communicating passage and the other end thereof connected to the common ink chamber, wherein a passage resistance of the restricted passage is the maximum in the pressure chamber and an ink passage extending from the common ink chamber to the pressure chamber, and wherein an area of an aperture of the communicating passage opening to the pressure chamber is smaller than a cross-sectional area of the pressure chamber.

With this construction, since the cross-sectional area of the communicating passage communicating between the throttle portion and the pressure chamber is reduced, the ink can be squirted from the nozzle as with high efficiency and at a high speed.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
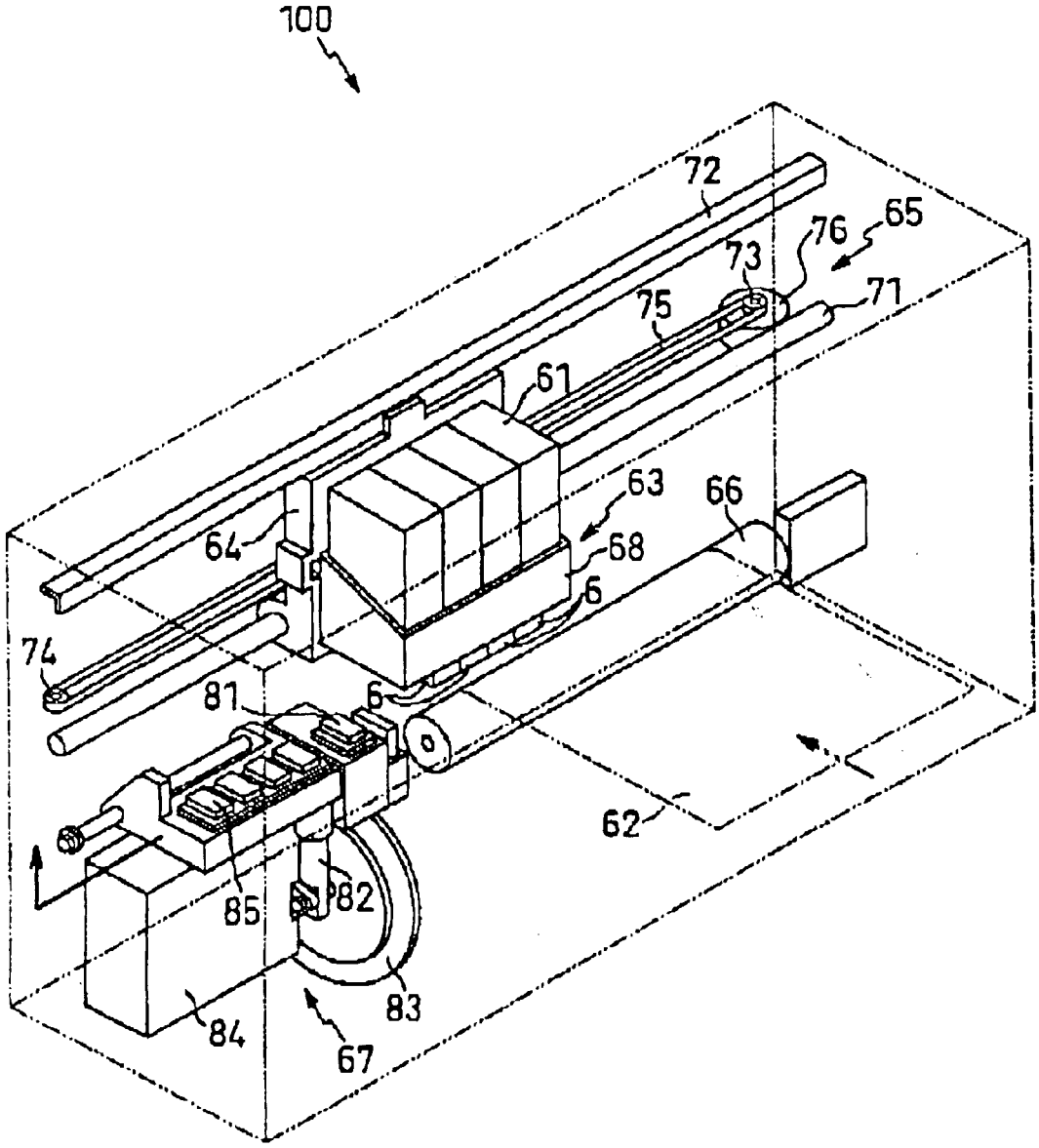
FIG. 1 is a schematic perspective view showing a color ink-jet printer to which an ink-jet head of the first embodiment of the present invention is applied.

In FIG. 1, a printer head 63 of a color ink-jet printer 100 mounts on its body frame 68 a total of four piezoelectric ink-jet heads 6 to squirt four color inks (e.g. cyan, magenta, yellow, and black) which are arranged in correspondence with their respective colors. Further, a total of four ink cartridges 61 filled with the color inks are detachably attached to the body frame 68. The body frame 68 is mounted on a carriage 64 reciprocally driven in a straight line by a drive mechanism 65. A platen roller 66 to feed a paper 62 is arranged so that its rotation axis can be parallel with the reciprocally driving direction of the carriage 64 to confront the ink-jet head 6.

The carriage 64 is slidably supported by a guide shaft 71 and a guide plate 72 arranged in parallel with the rotation axis of the platen roller 66. Pulleys 73, 74 are supported at places in the vicinity of both ends of the guide shaft 71, and an endless belt 75 is extended between the pulleys 73, 74. The carriage 64 is fixed to the endless belt 75. The one pulley 73 is fixed to a drive shaft of a motor 76. The motor 76, the pulleys 73, 74 and the endless belt 75 forms the drive mechanism 65.

In this construction, when the one pulley 73 is rotated in a normal rotation direction by the drive of the motor 76, the carriage 64 is driven in reciprocation linearly along the guide shaft 71 and the guide plate 72 in response to the normal rotation of the pulley 73. This provides the reciprocal movement of the printer head 63 along the scanning direction.

The paper 62 is fed from a paper feed cassette (not shown) provided at a lateral side of the ink-jet printer 100 into a space between the ink-jet head 6 and the platen roller 66 in a sub scanning direction and is discharged after a desired image is formed by the inks squirted from the ink-jet head 6. In FIG. 1, illustrations of a paper 62 feed mechanism and a paper 62 discharge mechanism are omitted.

A purge mechanism 67 shown in FIG. 1 serves to forcibly suck in bad inks including bubbles, dusts and the like accumulated in the ink-jet head 6.

The purge mechanism 67 is provided at a lateral side of the platen roller 66. To be more specific, the purge mechanism 67 is disposed at a location to confront the ink-jet head 6 when the printer head 63 is carried into a reset position by the drive mechanism 65.

The purge mechanism 67 is provided with a purge cap 81. The purge cap 81 is adapted to be closely contactable with lower surfaces of the ink-jet heads 6 to cover a number of nozzles arranged in the lower surfaces of the ink-jet head 6 (the details of the nozzles are mentioned later).

In this construction, when the printer head 63 is in the rest position, the nozzles of the ink-jet heads 6 mounted on the carriage 64 are covered with the purge cap 81. When a cam 83 is driven in this state, the purge cap 81 is vacuumed, so that a negative pressure is produced in an interior of the purge cap 81. This permits the bad ink including bubbles and impurities accumulated in the interior of the ink-jet head 6 to be sucked through the nozzles and discharged into a waste ink reservoir 84, so as to restore the ink-jet heads 6 to their former state.

This purge mechanism 67 can permit the air in the interior of the ink-jet head 6 to be sucked and purged at the initial feed of the ink to the ink-jet head 6 (at the start-up of the ink-jet printer 100), so as to fill the passage in the interior of the ink-jet head 6 with the ink. Even when some bubbles grow in the passage formed in the ink-jet head 6 to an extent to which the ink-jet head 6 cannot squirt the ink with a long-term use, the ink-jet heads 6 can be restored to their normally printing state by the purging operation of the purge mechanism 67.

Caps 85 shown in FIG. 1 serve to cover the nozzles of the ink-jet heads 6 of the printer head 63 to prevent drying of the ink when the printer head 63 is returned to the reset position after completion of printing.

Figure 2:
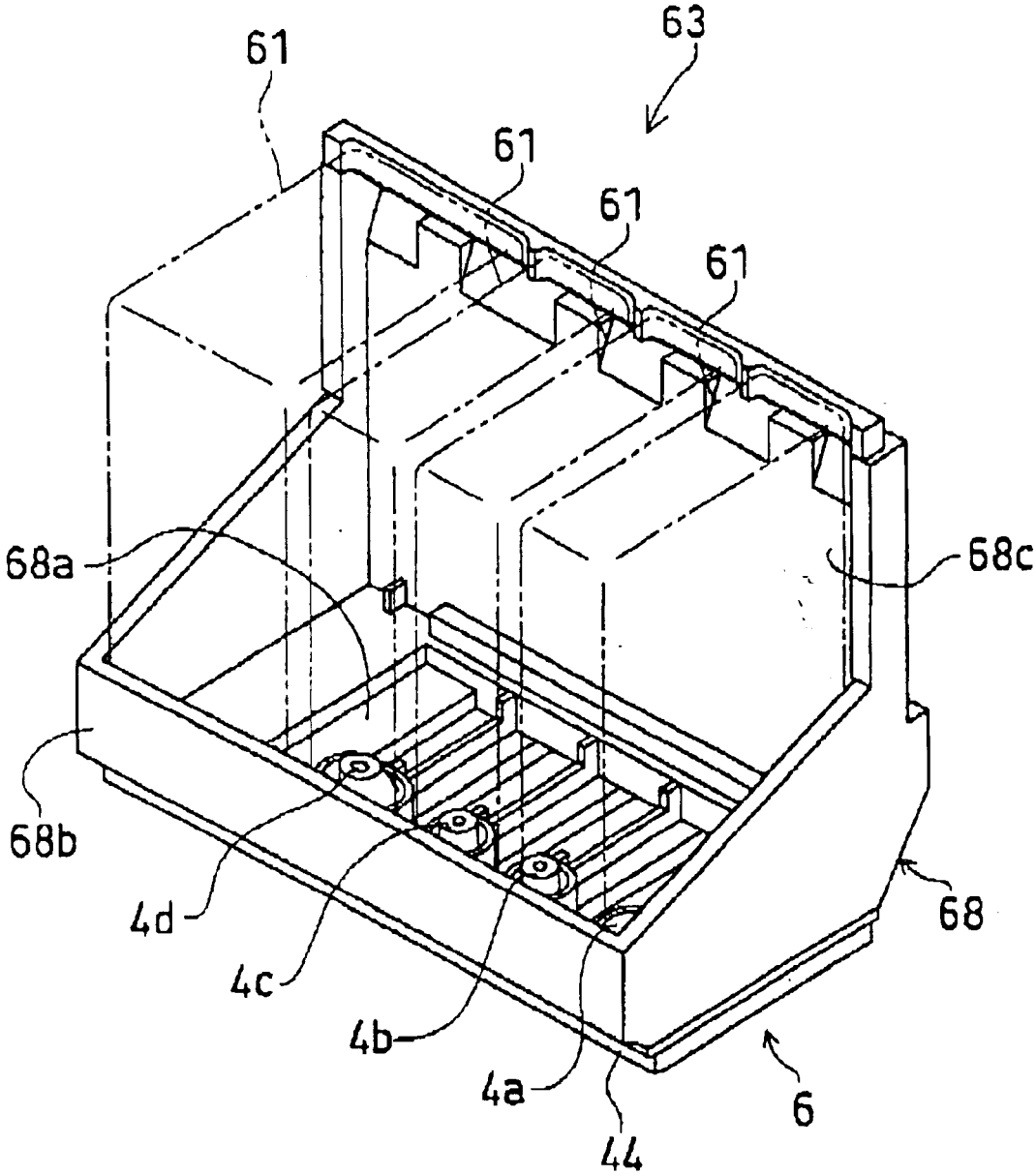
FIG. 2 is a perspective view of a printer head.

Now, reference is made to the structure of the printer head 63. As shown in FIG. 1, the printer head 63 is mounted on the carriage 6 that runs in a direction orthogonal to the carrying direction of the paper 62. The body frame 68 of the printer head 63 is formed in a generally box-like shape having a bottom wall 68*a*, a front wall 68*b* and a back wall 68*c* and opening at the top, as shown in FIG. 2. The body frame 68 has, at its box-like portion, a cartridge mounting portion which is formed so that four color ink cartridges 61 serving as the ink supply source can be detachably attached thereto from the opening side (from the above).

As shown in FIG. 2, four ink supply passages 4*a*–4*d* are arranged in an upper surface of the bottom wall 68*a* of the body frame 68 at locations near the front wall 68*b*. The respective ink supply passages 4*a*–4*d* are adapted to be connectable with ink discharge portions (not shown) of the ink cartridges 61 and are extended through the bottom wall 68*a* to a lower surface thereof. A rubber packing or equivalent (not shown) close-contactable with the ink discharge portions of the ink cartridges 61 is disposed on the upper surface (cartridge mounting portion) of the bottom wall 68*a* of the body frame 68.

Figure 3:
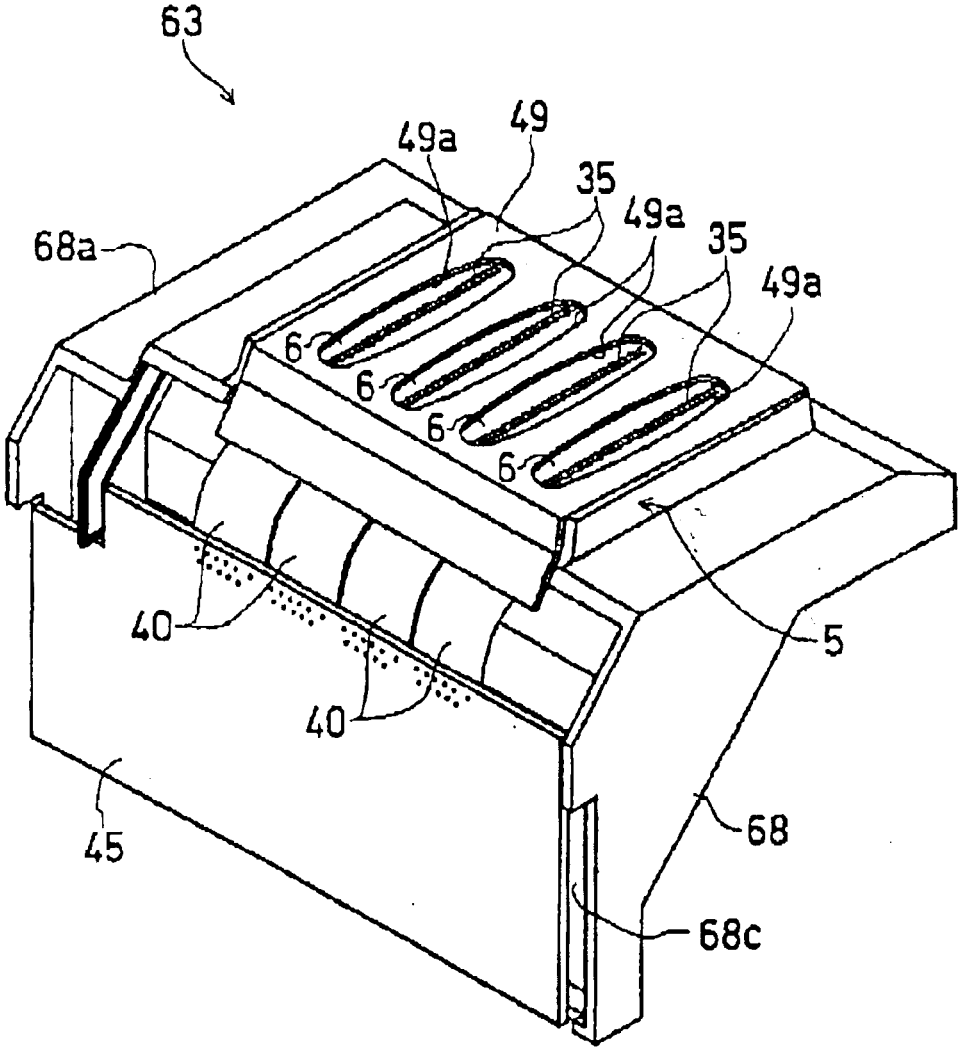
FIG. 3 is a perspective view showing an inverted state of the printer head.
Figure 4:
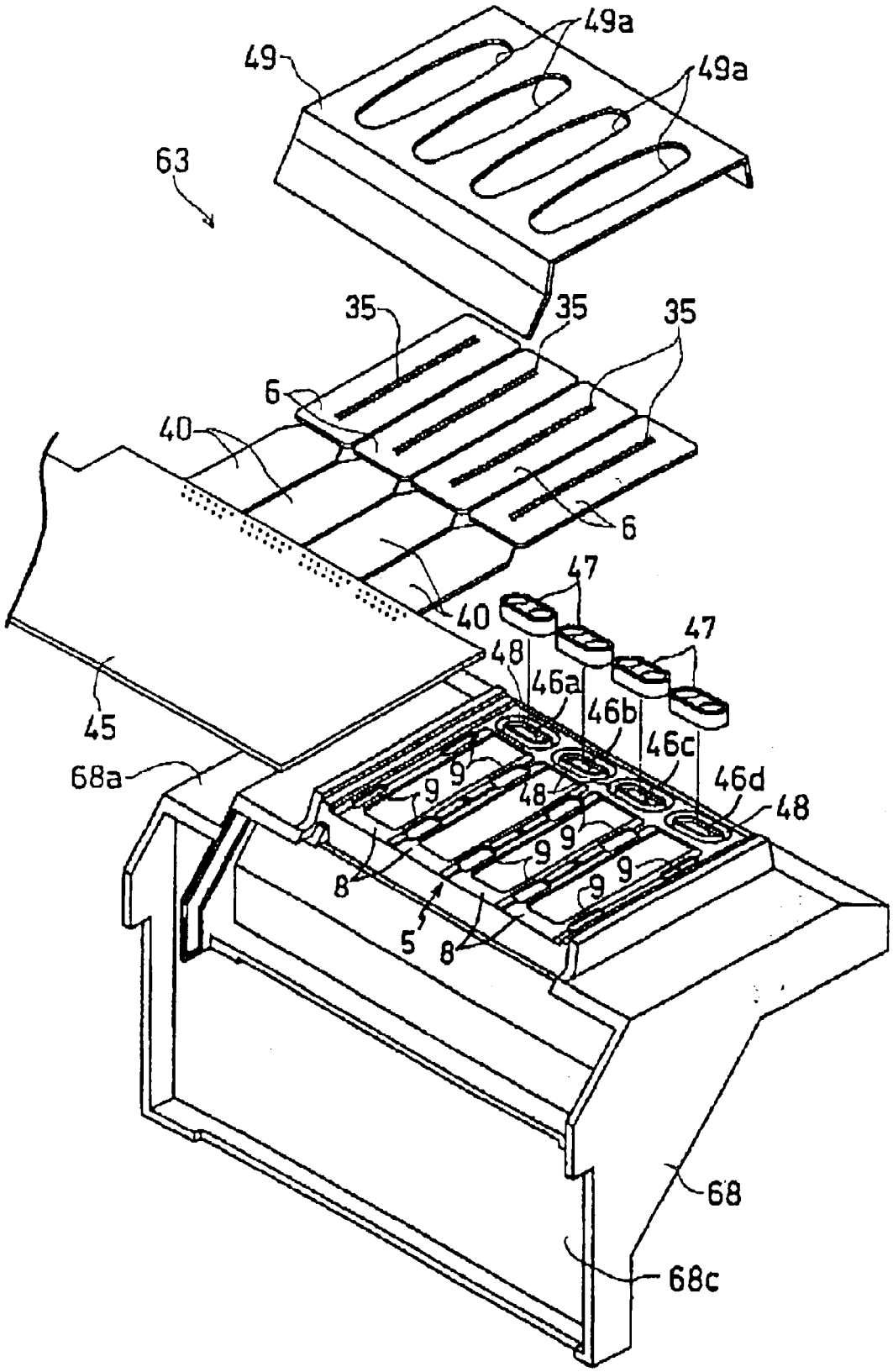
FIG. 4 is an exploded perspective view of the printer head.

As shown in FIGS. 3 and 4, a head holding portion 5 is formed at the lower surface side of the bottom wall 68*a* of the body frame 68. As shown in FIG. 4, the head holding portion 5 has four supporting portions 8 which are each formed in a stepped form. The four ink-jet heads 6 corresponding to the ink cartridges 61 are fixed to their respective supporting portions 8. Each supporting portion 8 has a plurality of empty spaces 9 formed to be vertically extended through it. The empty spaces 9 are used for bonding the ink-jet heads 6 to the supporting portions 8 via UV cure adhesive.

Further, a head cover 49 is laid over the four ink-jet heads 6 to cover the head holding portions 5 in whole. The head cover 49 has openings 49*a*, through which the nozzles 35 of the ink-jet heads 6 are exposed when the head cover 49 is attached to the ink-jet heads 6, as shown in FIG. 3.

As shown in FIG. 3, a generally rectangular circuit board 45 is disposed on an outer wall surface of the back wall 68*c* of the body frame 68 (a wall surface on a side thereof confronting the carriage 64 as viewed in FIG. 1) so that the board surface can be in parallel with the back wall 68*c*. As shown in FIG. 4, the ink-jet heads 6 are connected to the circuit board 45 through flexible flat cables 40, respectively.

As shown in FIG. 4, the supporting portions 8 are provided, at one ends thereof, with communicating portions 46*a*–46*d* communicating with the ink cartridges 61 through the ink supply passages 4*a*–4*d* (FIG. 2). Each of the communicating portions 46*a*–46*d* has a recessed fitting groove 48 formed therearound. A rubber packing 47 or equivalent is fitted in the fitting groove 48. When the ink-jet heads 6 are adhesive bonded to the supporting portions 8, front ends of the packing 47 are pressed against outer surfaces around ink supply ports 39 of the ink-jet heads 6 mentioned later (See FIG. 5). Thus, the connecting portions between the communicating portions 46*a*–46*d* and the ink supply ports 39 of the ink-jet heads 6 are sealed to prevent the ink from leaking.

[First Embodiment]

Figure 5:
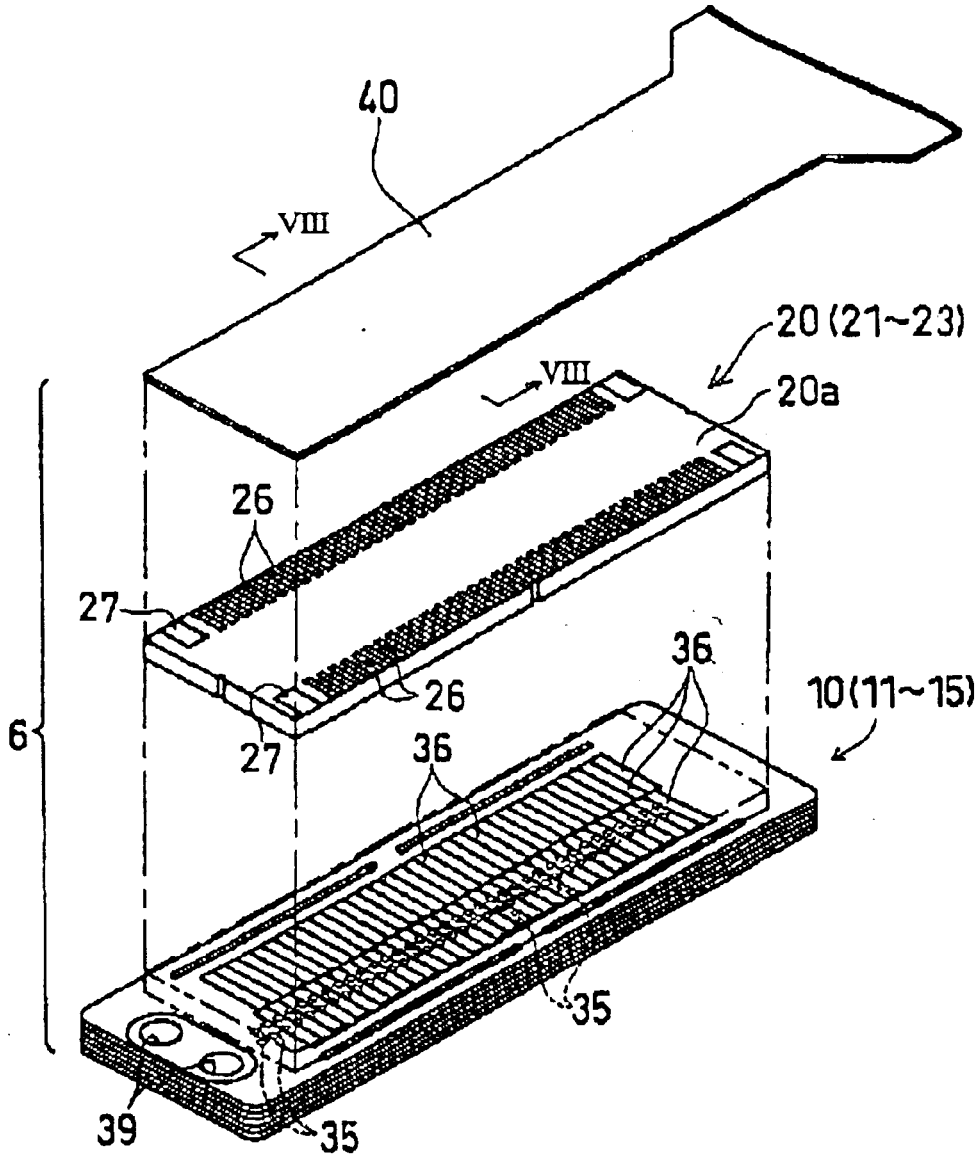
FIG. 5 is an exploded perspective view of the ink-jet head of the first embodiment.

Referring to FIG. 5, there is shown a perspective view of the ink-jet head 6 according to the first embodiment. The ink-jet head 6 has a rectangular passage unit 10 of the flat-plate laminated structure. A plate-type piezoelectric actuator (hereinafter they are simply referred to as "the actuator") 20 are bonded and laminated to the passage unit 10 via adhesive or adhesive sheet. Further, the flexible flat cable 40 for electrically connecting with the circuit board 45 is laid over an upper surface of the actuator 20 and is bonded thereto via the adhesive. The plurality of nozzles 35 are opened in a lower surface of the passage unit 10 (on a side thereof confronting the platen roller 66), so that the ink is squirted downwardly from the nozzles 35.

Figure 6:
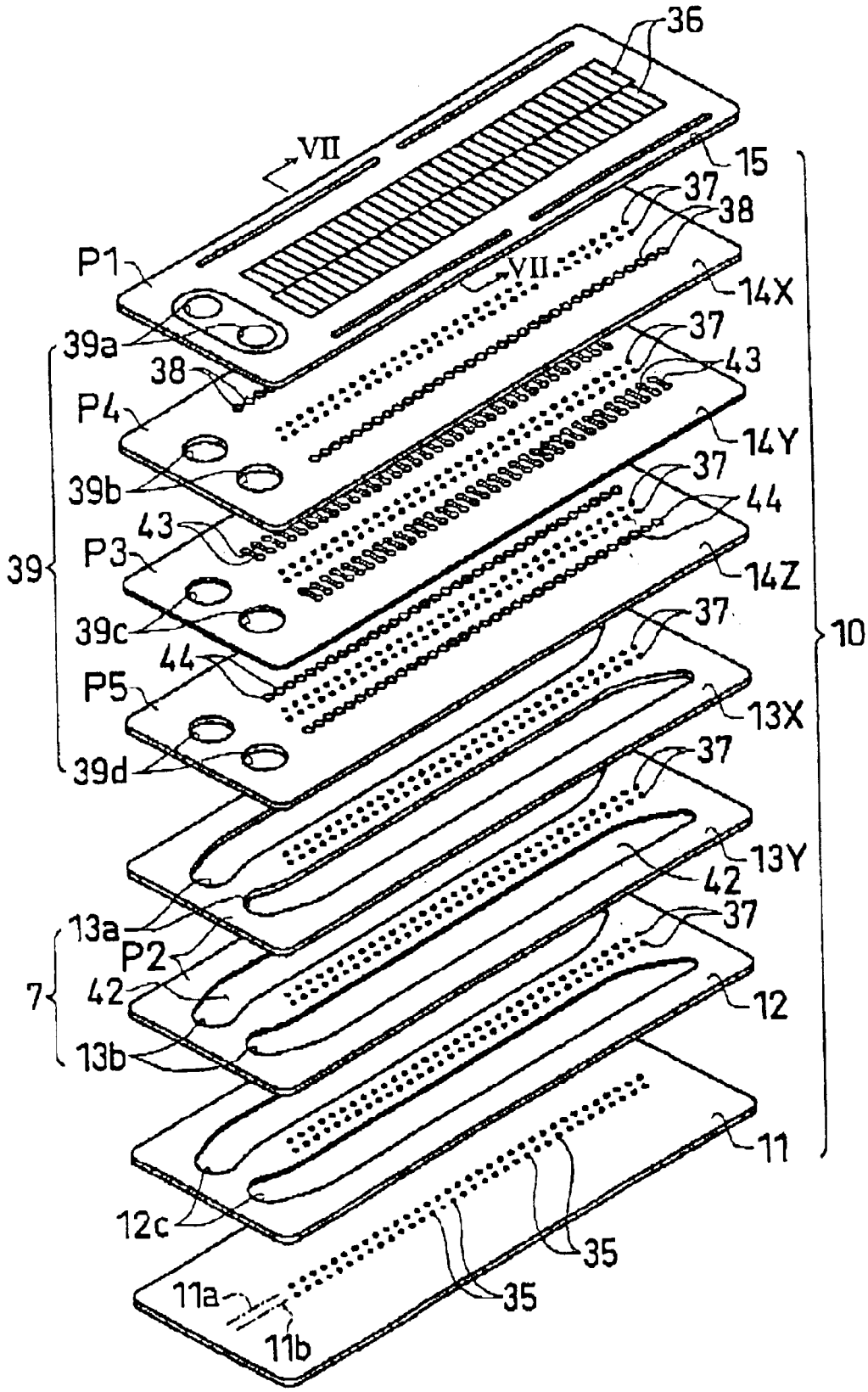
FIG. 6 is an exploded perspective view showing a laminated structure of a passage unit.
Figure 7:
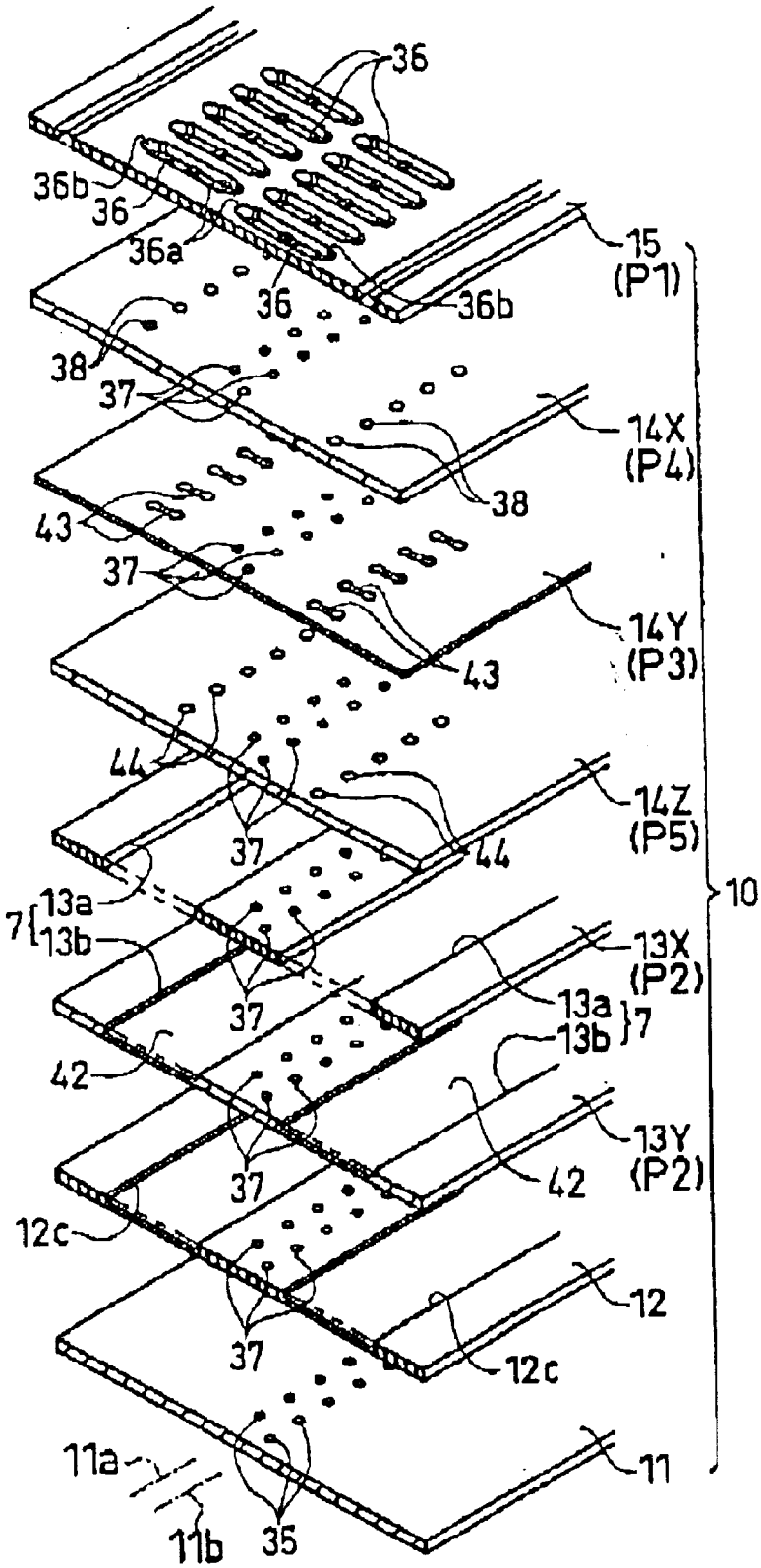
FIG. 7 is an exploded perspective view showing a cross-sectional view taken along line VII—VII of FIG. 6.

FIG. 6 shows an exploded perspective view of the passage unit 10 and FIG. 7 shows an exploded perspective view thereof (a cross-sectional view taken along line VII—VII of FIG. 6). As shown in FIGS. 6 and 7, the passage unit 10 has the structure wherein a total of eight thin, flat plates, comprising a nozzle plate 11, a damper plate 12, two manifold plates 13X, 13Y, three spacer plates 14X, 14Y, 14Z, and a base plate 15, are laminated to one another via adhesive.

In the first embodiment, the flat plates 11–15 are made of a 42% nickel alloy. All the flat plates 11–15 have an elongated rectangular shape and have a thickness of the order of 50 μm–150 μm, except an intermediate spacer plate 14Y. The intermediate spacer plate 14Y has a thickness of about 25 μm.

The nozzle plate 11 has a number of ink squirting nozzles 35 having a small diameter (approximately 25 μm in this embodiment) formed therein, as shown in FIGS. 6 and 7. The nozzles 35 are staggered in two lines along center lines 11*a*, 11*b* in the nozzle plate 11, with spaced apart from each other.

The base plate 15 (the first flat plate P1) has a number of pressure chambers 36, 36, . . . bored therein and staggered in two lines along a longitudinal direction thereof, as shown in FIG. 7. The pressure chambers 36 are each formed in an elongated shape so that the direction of elongation of the pressure chambers can be orthogonal to the longitudinal direction of the base plate 15.

The pressure chambers 36 are equally spaced along the direction of the surface of the base plate 15. As a result, the pressure chambers 36 thus arrayed form a plane vertical to a thickness direction of the base plate 15, when viewed as a whole.

Figure 8:
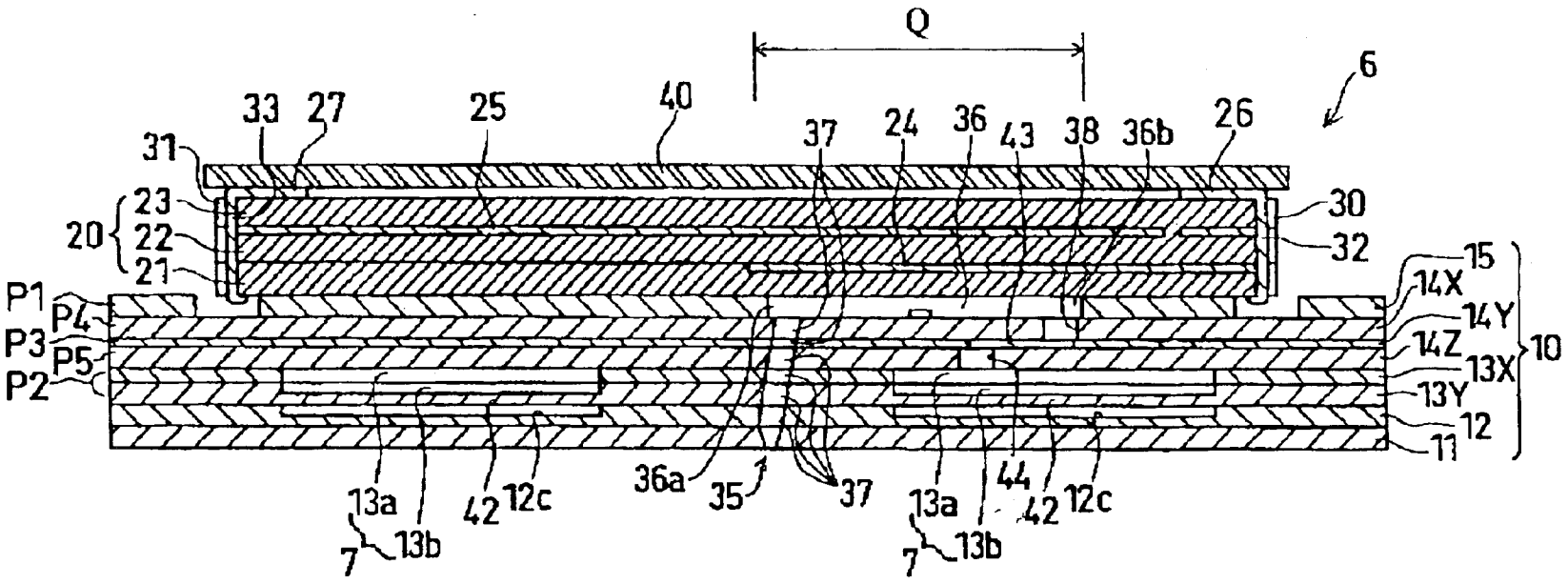
FIG. 8 is a cross-sectional view taken along line VIII—VIII of FIG. 5.

As shown in FIGS. 7 and 8, one end portions of the pressure chambers 36 communicate with the nozzles 35 formed in the nozzle plate 11 through through-holes 37 of a small diameter which are bored and staggered in the three spacer plates 14X, 14Y, 14Z, two manifold plates 13X, 13Y and damper plate 12 in the same manner.

As shown in FIGS. 7 and 8, an upper spacer plate 14X (the fourth flat plate P4) lying next to the base plate 15 has ink supply holes (communicating passages) 38 bored therein at locations corresponding to the other end portions 36*b* of the pressure chambers 36. The ink supply holes 38 are formed to extend through the upper spacer plate 14X in a thickness direction thereof. The ink supply holes 38 extend in the thickness direction of the upper spacer plate 14X, with one ends thereof connected to the other end portions 36*b* of the pressure chambers 36 and the other ends thereof connected to throttle portions 43 (mentioned later). The throttle portions 43 are positioned in a plane parallel with the plane formed by the pressure chambers 36 in the base plate 15.

As shown in FIGS. 7 and 8, the throttle portions (restricted passages) 43 are formed in the intermediate spacer plate 14Y (the third flat plate P3) in an elongated shape to extend along the direction of the plane of the intermediate spacer plate 14Y. Specifically, the direction of elongation of the throttle portions 43 is parallel with the direction of elongation of the pressure chambers 36 (See FIGS. 7, 11 and 12). The throttle portions 43 are formed to extend through the intermediate spacer plate 14Y in a thickness direction thereof. One lengthwise ends of the throttle portions 43 are communicated with the ink supply holes 38.

The other lengthwise ends of the throttle portions 43 are connected to feed holes (communicating passages) 44 formed in a lower spacer plate 14Z (the fifth flat plate P5). The feed holes 44 are formed to extend through the lower spacer plate 14Z in a thickness direction thereof. The feed holes 44 extend in the thickness direction of the lower spacer plate 14Z, with one ends thereof connected to the throttle portions 43 and the other ends thereof connected to a common chamber 7 mentioned below.

Of the two manifold plates (13X, 13Y), the manifold plate 13X closer to the lower spacer plate 14Z has two half-segmented ink chambers 13*a*, 13*a* formed to extend therethrough, as shown in FIG. 7. On the other hand, the manifold plate 13Y closer to the nozzle plate 11 is recessed to form two half-segmented ink chambers 13*b*, 13*b* opening to the other manifold plate 13X only.

In this construction, when the two manifold plates 13X, 13Y and the lower spacer plate 14Z, i.e., the three plates in total, are laminated, the corresponding upper and lower half-segmented ink chambers 13*a*, 13*b* are connected to each other to form two common ink chambers, one at each side of the line of through holes 37, as shown in FIG. 8. In this embodiment, the two manifold plates 13X, 13Y correspond to the second flat plate P2.

The two common ink chambers 7, 7 are arranged substantially in parallel with the lines of through holes 37, with the lines of through holes 37 sandwiched between the common ink chambers 7, 7, as shown in FIG. 6. The common ink chambers 7, 7 are positioned in a plane parallel with the plane formed by the pressure chambers 36 in the base plate 15 and also positioned closer to the nozzle plate 11 than to the pressure chambers 36.

The common ink chambers 7, 7 are arranged on both sides of the lines of through holes 37 to correspond in position to the pressure chambers 36 and nozzles 35 arranged in two rows. Specifically, one common chamber 7 communicates with the pressure chambers 36 and nozzles 35 in one of the two lines through the ink supply holes 38 of the spacer plate 14, and the other common chamber 7 communicates with the pressure chambers 36 and nozzles 35 in the other line through the ink supply holes 38 of the spacer plate 14 in the same manner.

By constructing the ink-jet heads 6 in this manner, a two-tone printing mode to print in two different colors by using a single ink-jet head 6 can be taken by supplying the inks of two different colors to the two common ink chambers 7, 7, respectively. This can increase the versatility of the ink-jet head 6 to decrease the number of parts in variety. In the illustrated embodiment, the printing mode to print in one color and with high resolution by using the two lines of nozzles 35 is taken by supplying the ink of the same color to the both common ink chambers 7, 7 of each ink-jet head 6, however.

As shown in FIG. 7, the damper plate 12 located immediately under the manifold plates 13X, 13Y is recessed to form damper grooves 12*c*, 12*c*. The damper grooves 12*c*, 12*c* are formed to open to the manifold plate 13Y only and correspond in position and shape to the common ink chambers 7, 7 completely.

In this construction, when the manifold plates 13X, 13Y and the damper plate 12 are bonded, the damper grooves 12*c* will be positioned in the half-segmented ink chambers 13*b* of the recessed manifold plate 13Y (the damper portions 42). It is to be noted here that since the manifold plate 13Y is formed of proper elastically-deformable metal material (a 42% nickel alloy in this embodiment), the damper portions 42 can freely oscillate to the common ink chamber 7 side and the damper groove 12*c* side.

The construction mentioned above can provide the result that even when pressure fluctuation in the pressure chambers generated at the squirting of the ink is propagated to the common ink chambers 7, since the damper portions 42 elastically deform and oscillate, the pressure fluctuation can be absorbed and damped (damping operation) by the damper portions 42 to prevent propagation of the pressure fluctuation to other pressure chambers 36 (cross talk).

As shown in FIG. 6, the base plate 15 has two supply holes 39*a* formed therein, and each of the three spacer plates 14X, 14Y, 14Z also has the two supply holes 39*b*–39*d* formed therein. By bonding the base plate 15 and the spacer plates 14, the corresponding supply holes 39*a*–39*d* are connected with each other to form the two ink supply ports 39, 39, one for each of the two common ink chambers 7, 7.

In order to meet the demands for downsizing of the ink-jet head 6, the two ink supply ports 39, 39 are bored at locations near the one ends of the lines of pressure chambers 36, 35, . . . and arranged close to each other. The ink supply ports 39 are provided with filters, not shown, so that when foreign matter is entrained in the ink at the attachment and detachment of the ink cartridge 61 to and from the cartridge mounting portion, the foreign matter can be prevented from getting into the common ink chambers 7.

By virtue of this construction of the passage unit 10, the ink flowing from the ink supply ports 39, 39 into the common ink chambers 7, 7 is fed from the feed holes 44 to the other end portions 36*b* of the pressure chambers 36 through the throttle portions 43 and the ink supply holes 38. In other words, the ink in the common chambers 7, 7 is distributed to the respective pressure chambers 36. Then, after having being energized for squirting in the respective pressure chambers 36 by actuators 20 mentioned later, the ink is fed from one ends 36*a* of the pressure chambers 36 to their respective nozzles 35 via the through holes 37 and is squirted from the nozzles.

Figure 9:
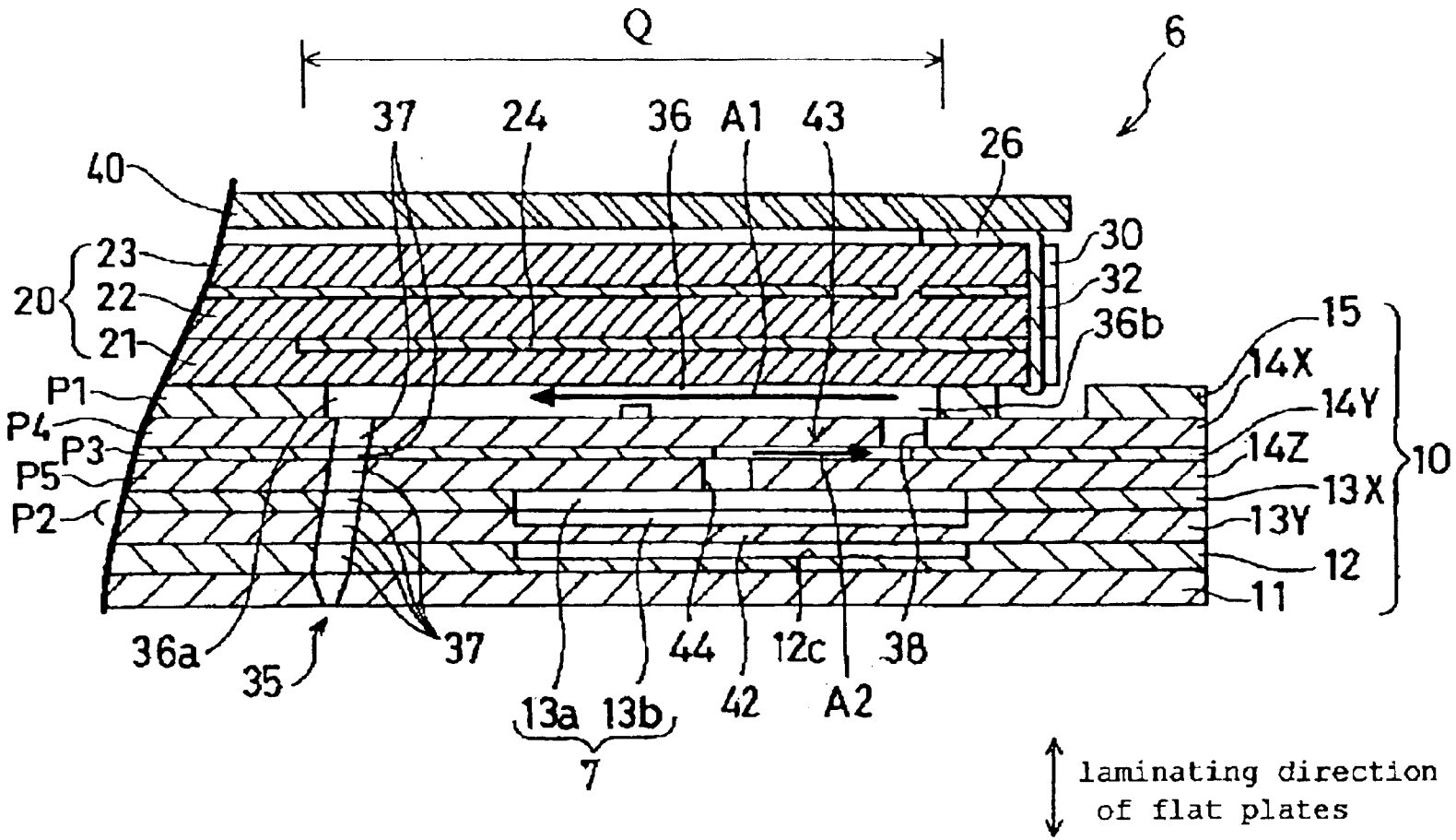
FIG. 9 is an enlarged cross-sectional view showing the details of the passage structure in an interior of the passage unit.
Figure 10:
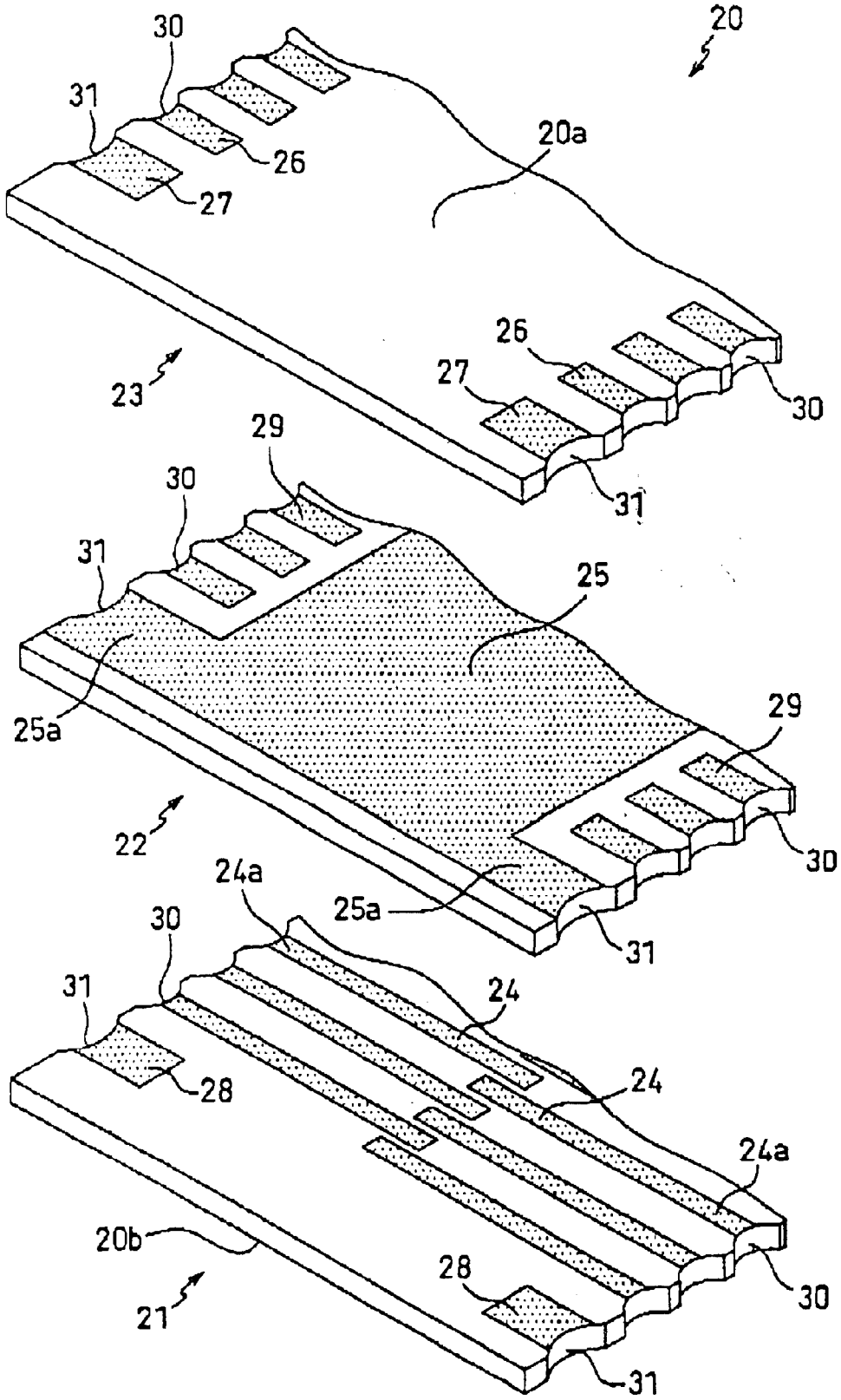
FIG. 10 is an exploded perspective view showing a laminated structure of actuators.

FIG. 10 shows an enlarged exploded perspective view of the actuator 20. The actuator 20 has the laminated construction wherein two kinds of piezoelectric sheets 21, 22 and a dielectric sheet 23 are laminated, as shown in FIGS. 8–10. In this embodiment, the piezoelectric sheets 21, 22 are made of lead zirconate titanate (PZT) ceramic material having ferroelectricity.

As shown in FIG. 10, one piezoelectric sheet 21 has a plurality of elongate drive electrodes 24 staggered on its upper surface, one for each of the pressure chambers 36 in the passage unit 10. The drive electrodes 24 are formed so that their one ends 24*a* can be exposed to both right and left side surfaces of the actuator 20 orthogonal to front and back surfaces 20*a*, 20*b* of the actuator 20.

The other piezoelectric sheet 22 has, on its upper surface, a plurality of common electrodes 25 common to the plurality of pressure chambers 36. The common electrodes 25 are formed so that their one ends 25*a* can be exposed to both right and left side surfaces of the actuator 20, as in the case of the one ends 24*a* of the drive electrodes 24. The piezoelectric sheets 21, 22 may be alternately laminated by twos or more, without limited to the illustrated lamination that the piezoelectric sheets are alternately laminated by ones or on a one-by-one basis. The areas between the drive electrodes 24 and the common electrodes 25 in the piezoelectric sheets 21, 22 serve as pressure generating areas corresponding to the pressure chambers 36.

The dielectric sheet 23 located at the top of the actuator has, on its upper surface, surface electrodes 26, 27 associated with the drive electrodes 24 and the common electrodes 25, respectively, arranged along the right and left sides.

Also, the dielectric sheet 23 has, at its right and left sides, first recessed grooves 30 and second recessed grooves 31 corresponding in position to the one ends 24*a* of the drive electrodes 24 and the one ends 25*a* of the common electrodes 25, respectively, and formed to extend along the laminating direction. As shown in FIG. 8, the first recessed grooves 30 contain side electrodes 32 for electrically connecting between the drive electrodes 24 and the surface electrodes 26, and the second recessed grooves 31 contain side electrodes 33 for electrically connecting between the common electrodes 25 and the surface electrodes 27. In FIG. 10, electrodes denoted by reference numerals 28, 29 are unused pattern electrodes.

The passage unit 10 and actuator 20 thus constructed are laminated, with the pressure chambers 36 of the passage unit 10 and the drive electrodes 24 of the actuator 20 aligned with each other, as shown in FIG. 5. A variety of wiring patterns (not shown) of the flexible flat cables 40 are electrically connected to the surface electrodes 26, 27 on the upper surface 20*a* of the actuator 20.

When voltage is applied between any drive electrode 24 selected from the plurality of drive electrodes 24 and the common electrode 25 of the actuator 20 of the ink-jet head 6, deformation is developed in the laminating direction in the area of the drive electrode 24 of the piezoelectric sheet 22 to which the voltage is applied (i.e., the pressure generating area) by the piezoelectricity and, as a result, the pressure chambers 36 are contracted and decreased in volume. This provides a squirting energy to the ink in the pressure chambers 36, so that the droplets of the ink are squirted from the nozzles 35 to print a desired image on the paper 62. While the printer head 63 is driven in reciprocation in the main scanning direction by driving the carriage 64 (FIG. 1) and also the paper 62 is intermittently fed in the sub scanning direction by the platen roller 66, the ink is squirted from the ink-jet heads 6. This enables a desired image to be formed on the paper 62.

Figure 11:
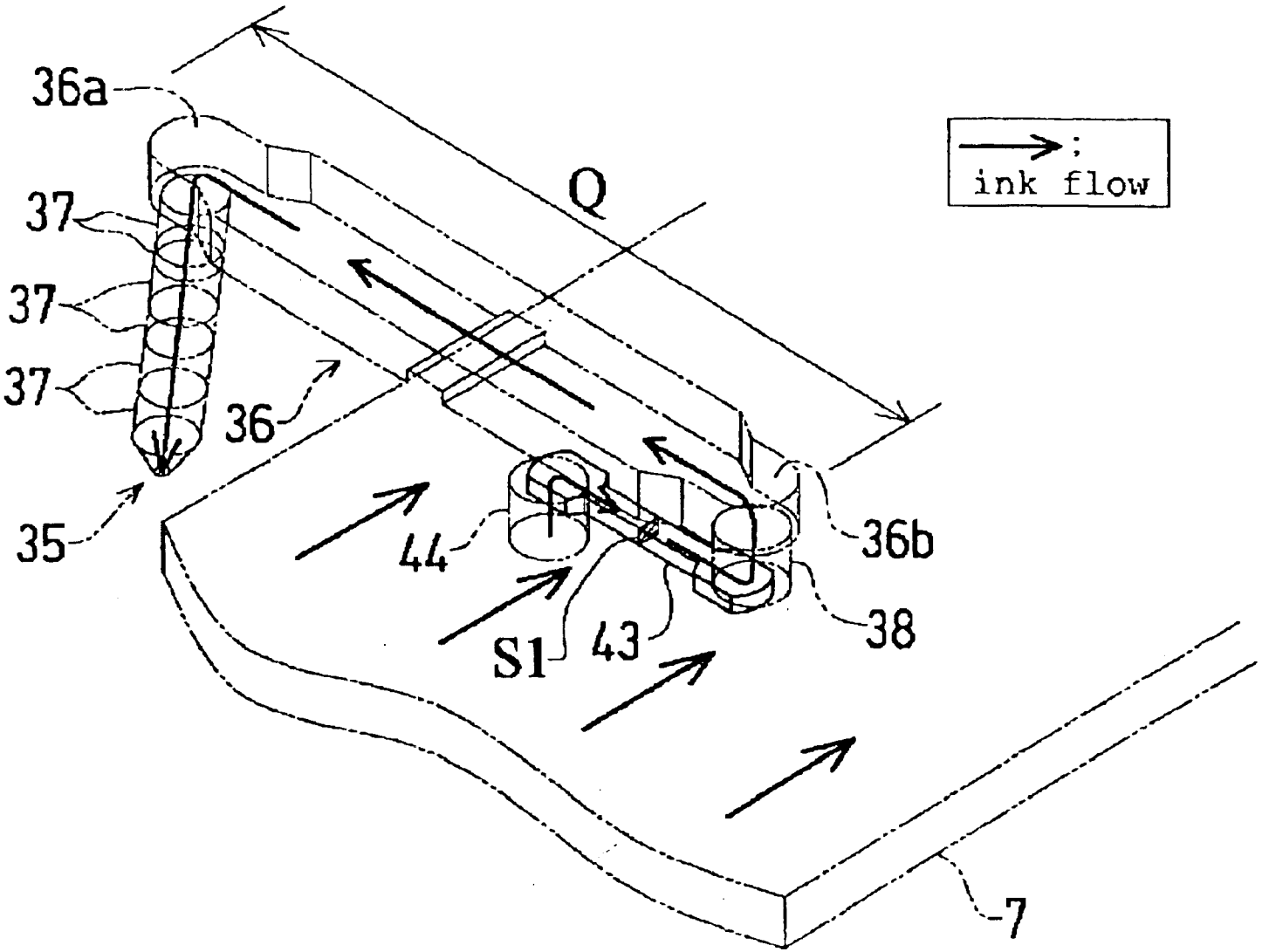
FIG. 11 is a perspective view showing an ink flow from a common ink chamber to a nozzle through a throttle portion and the pressure chamber.

In the illustrated embodiment, the throttle portions 43 serving as the restricted passage are formed in the intermediate spacer plate 14Y (the third flat plate P3) which is a flat plate different from the base plate 15 (the first flat plate P1) forming the pressure chambers 36 therein, as shown in FIGS. 7 and 9. The throttle portions 43 are elongated along the direction of the surface of the intermediate spacer plate 14Y. Also, they are formed to extend from their one ends connected with the pressure chambers 36 through the ink supply holes 38 in the direction parallel with the plane formed by the plurality of pressure chambers 36, as shown in FIG. 11 and others.

This can provide the result that when the passages corresponding to the nozzles 35 are arranged in the interior of the passage unit 10, interference between the pressure chambers 36 and the throttle portions 43 can be avoided. This can provide a downsized ink-jet head 6 and also can meet the demands for realization of a high-integration and high-density passage arrangement accompanied by the needs of a high resolution of picture. Also, since the throttle portions 43 extend in the direction parallel with the plane formed by the plurality of pressure chambers 36, the space required for the passages can be kept at a minimal increase with respect to the laminating direction.

Also, by forming the pressure chambers 36 and the throttle portions 43 to be separate from each other, the difficulty involved in the prior art that the both parts must be formed in a single flat plate with high precision can be eliminated. This can produce increased yield and thus reduced production cost.

In this embodiment, the pressure chambers 36, the ink supply holes 38, the throttle portions 43 and the common ink chambers are previously formed in each of individual flat plates, first, and, then, those individual flat plates are laminated together to thereby produce the passage unit 10. This can provide a simplified production method.

The throttle portions 43 provide largest passage resistance to restrict the back-flow of the ink trying to flow back to the common chambers 7 from the pressure chambers 36. This can provide reduction in quantity of back-ink flowing back to the common chambers 7 from the pressure chambers 36, and as such can allow the ink to be squirted from the nozzles 35 stably. Immediately after squirting, the ink is supplied from the common ink chambers 7 to the pressure chambers 36 through the throttle portions 43 to restore meniscus in the nozzles 35 to its former state in a short time.

In this embodiment, the throttle portions 43 are formed to extend along the direction of the surface of the intermediate spacer plate 14Y. This can provide an adequately controlled setting of throttling operation (throttling resistance against the ink flow) to provide resistance against the ink flow from the common ink chambers 7 to the pressure chambers 36, as compared with the case where the throttle portions are formed to extend along the thickness direction. Specifically, to increase a length of the throttle portion 43 (length L2 shown in FIG. 12) is one of the ways of increasing the passage resistance. In the illustrated embodiment in which the throttle portions 43 are formed to extend along the surface of the intermediate spacer plate 14Y, it is easy to make a design change of the length of the throttle portion 43.

In the illustrated embodiment, the direction of elongation of the throttle portions 43 is parallel with the longitudinal direction of the pressure chambers 36, as shown in FIG. 11. This can provide the construction to incorporate the passage structure including the throttle portions 43 and the pressure chambers 36 in the passage unit 10 with ease and with high density. Therefore, this construction can further meet the demands for the high-integration and high-density passage arrangement.

As shown in FIG. 9, the direction A2 of the ink flowing through the throttle portions 43 is parallel with but opposite to the direction A1 of the ink flowing through the pressure chambers 36. Specifically, the ink flows through the throttle portions 43 along the direction of the surface of the intermediate spacer plate 14Y, then flows through the ink supply holes 38 in the thickness direction, and then flows through the pressure chambers 36 along the direction of the surface of the base plate 15. Further specifically, the ink flows from the throttle portions 43 to the pressure chambers 36 through the ink supply holes 38, while U-turning, as shown in FIG. 11.

Figure 13:
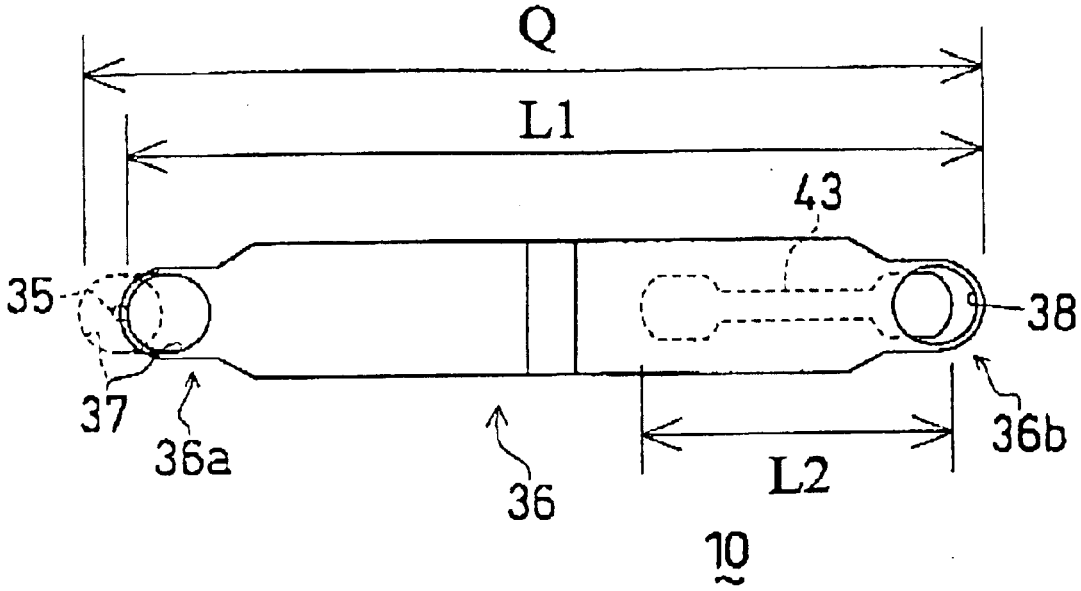
FIG. 13 is a plan view of the passage structure as viewed in the laminating direction of flat plates.

When viewed from the ink passage structure, the pressure chambers 36 communicating to the throttle portions 43 are located at one thicknesswise sides of the throttle portions 43, and the common ink chambers 7 are located at the other thicknesswise sides of the same, as shown in FIG. 9. When viewed from the thickness direction, the throttle portions 43 are overlapped with the pressure chambers 36 to be included in the pressure chambers 36, as shown in FIG. 13 and others.

By virtue of this construction, the ink passage extending from the feed holes 44 to the nozzles 35 through the throttle portions 43, the ink supply holes 38, and the pressure chambers 36 can be incorporated in the space of a short length (a width Q shown in FIGS. 8, 9 and 11) with respect to the longitudinal direction of the pressure chambers 36 in a rational way. Accordingly, the dimension of the ink-jet heads 6 with respect to the direction of elongation of the pressure chambers 36 can be decreased to provide a compact ink-jet head 6. To be more specific, the construction of this embodiment enables the length of the base plate 15 and equivalent with respect to the longitudinal direction of the pressure chambers 36 to be decreased, as compared with the conventional construction wherein the throttle portions are formed in the base plate 15 (the first flat plate P1) and are connected to the pressure chambers 36. This enables the ink-jet head 6 to be downsized.

When the ink flows from the throttle portions 43 into the pressure chambers 36, the ink flow passing through the throttle portions 43 and running at a high speed is led into the other ends **36*b* of the pressure chambers 36 in the direction perpendicular to the longitudinal direction of the pressure chambers 36. In other words, the passage arrangement is such that such a high-speed ink flow is prevented from running directly to a main part of the pressure chamber 36 (a lengthwise center part thereof). This can suppress generation of a vortex in the interior of the pressure chamber 36** and generation of bubbles resulting therefrom.

Figure 12:
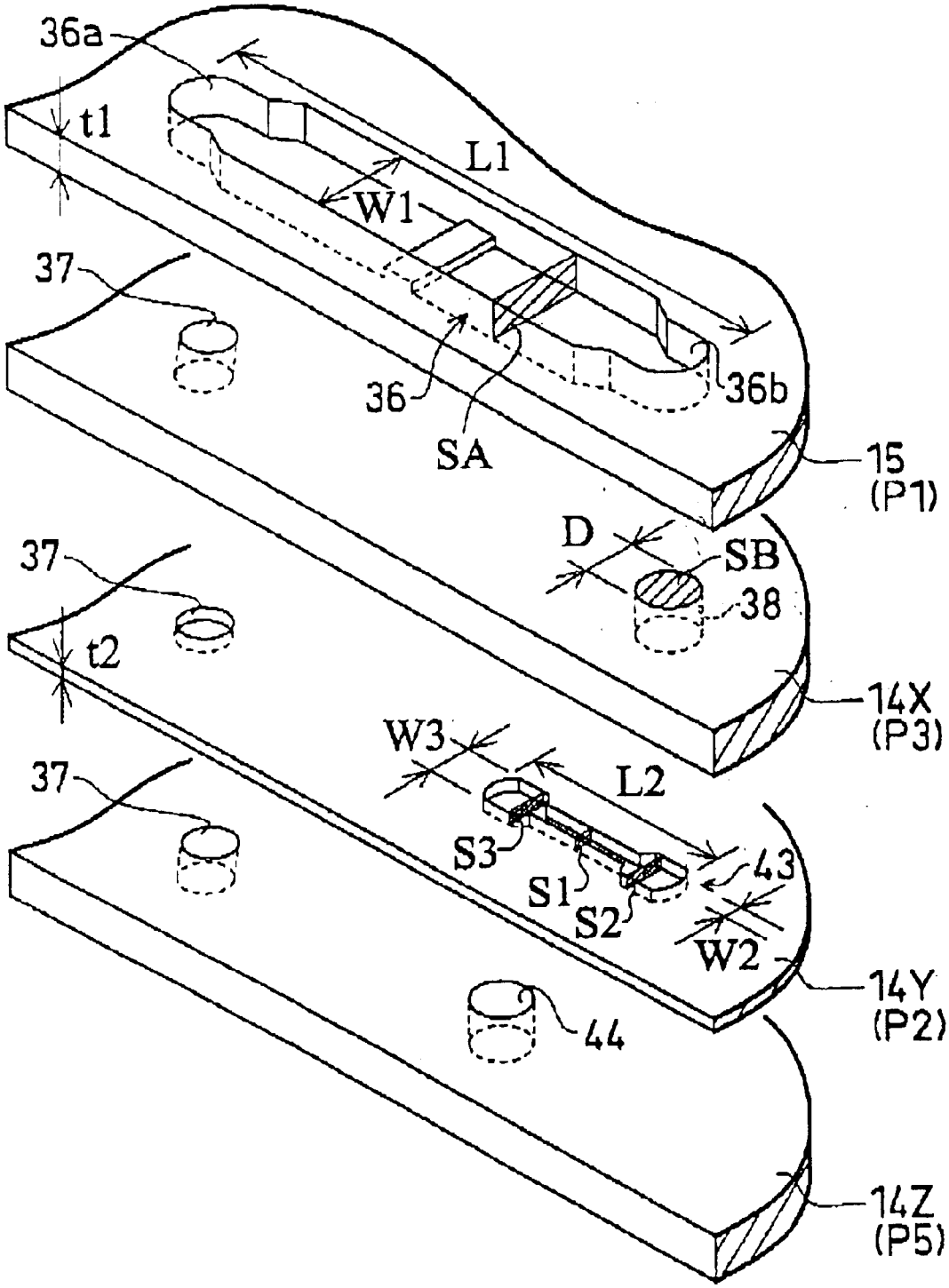
FIG. 12 is an exploded perspective view showing the details of the passage structure.

As shown in FIG. 12, the length L2 of the throttle portion 43 is shorter than the length L1 of the pressure chamber 36. When viewed from the thickness direction (when viewed form the laminating direction of the flat plates), the length L2 of the throttle portion 43 is included in the length L1 of the pressure chamber 36, as shown in FIG. 13. This arrangement enables the ink passage including the throttle portions 43 and the pressure chambers 36 to be incorporated in a limited space.

In this embodiment, the throttle portions 43 are formed to extend through the intermediate spacer plate 14Y (the third flat plate P3), as shown in FIGS. 8, 9 and 12. This enables variation in passage resistance of the throttle portion 43 to be reduced, and as such can allow variation in quantity of the ink squirted from the nozzles 35 to be reduced.

Specifically, when pressure wave is generated in the interior of the pressure chamber 36 by the drive of the actuator 20, the pressure wave causes the ink to squirt toward the nozzle 35, while on the other hand, the reflective wave moves toward upstream of the ink flow and in turn toward the common ink chamber 7. The passage resistance of the throttle portion (the restricted passage) 43 affects the ink flow from the pressure chamber 36 toward the common chamber 7 considerably. Due to this, it is important to reduce the variation in quantity of the ink squirting from the nozzle 35.

Now, if the throttle portion 43 is tried to be formed in a grooved shape from one side of the intermediate spacer plate 14Y by using the halt etching technique, an etching speed will vary easily due to various factors including a temperature of etching solution and a degree of deterioration of the etching solution, then leading to variation in depth of the groove. It should be noted that since the passage resistance of the throttle portion 43 is inversely proportioned to the cross-sectional area of the passage (=a depth of groove×a width of groove), the variation in depth of groove is directly related with the variation in passage resistance. Thus, deterioration in quality of print will be caused by an excess ejection or an insufficient ejection of ink from the nozzle 35.

On the other hand, in the illustrated embodiment, the throttle portion 43 serving as the restricted passage is formed to extent through the intermediate spacer plate 14Y in the thickness direction, as shown in FIGS. 8, 9 and 12. As a result, dimensional precision of the depth of the throttle portion 43 depends on dimensional precision of the thickness of the intermediate spacer plate 14Y. This means that the depth of the throttle portion 43 and thus the cross-sectional area of the passage (the area S1 shown in FIGS. 11 and 12) can be determined with high precision. As a result, variation in passage resistance of the throttle portion 43 is reduced, thus providing improvement in quality of ink-jet record.

In the illustrated embodiment, the intermediate spacer plate 14Y is made smaller in thickness t2 than the other flat plates, as shown in FIG. 12. The base plate 15 (the first flat plate P1) has a thickness t1 of about 40 μm to about 50 μm and the intermediate spacer plate 14Y (the third flat plate P3) has a thickness t2 of about 25 μm, so that the intermediate spacer plate 14Y is thinner than the base plate 15 (t2<t1). As a matter of fact, the thickness t2 of the intermediate spacer plate 14Y is the smallest of the eight flat plates 11–15 forming the passage unit 10.

It should be noted that since the throttle portion 43 is bored to extend through the intermediate spacer plate 14Y, as mentioned above, the depth of the throttle portion 43 is equal to the thickness t2 of the intermediate spacer plate 14Y. Accordingly, the depth of the throttle portion 43 is reduced (about 25 μm).

If the depth of the throttle portion 43 is large, the passage of the throttle portion 43 must be excessively narrowed in width to form a cross-sectional area S (=width×depth) required for providing an adequate resistance to the ink flow, resulting in extreme difficulty in manufacturing. Or, the passage of the throttle portion 43 must be elongated, resulting in impairment of compact passage structure.

However, in the illustrated embodiment, although the throttle portion 43 is formed to extend through the intermediate spacer plate 14Y in the thickness direction, since the intermediate spacer plate 14Y has the thickness as thin as 25 μm, the depth of the throttle portion 43 can be made small. Thus, there is little need to narrow the width of the passage of the throttle portion 43 and, accordingly, it is easy to manufacture the throttle portion 43.

Also, by reducing the thickness of the intermediate spacer plate 14Y in the way as mentioned above, not only etching techniques but also press stamping techniques can be adopted as a technique of forming the throttle portions 43. When using the press stamping technique, the throttle portion 43 should be rounded off at connecting corners between narrowed portions of the throttle portion 43 and spreading portions thereof extending from both ends of the narrowed portions (at 43*f* of FIG. 14) to facilitate the pressing work. In the etching work, the width of the throttle portions 43 can be produced with a dimensional precision of ±15 μm −20 μm, whereas, in the pressing work, it can be produced with a dimensional precision of ±5 μm. Accordingly, by adopting the pressing work, a margin of error in forming the throttle portions 43 can be reduced, and as such can allow the variation in quantity of ink squirted from the nozzles 35 to reduce.

Figure 14:
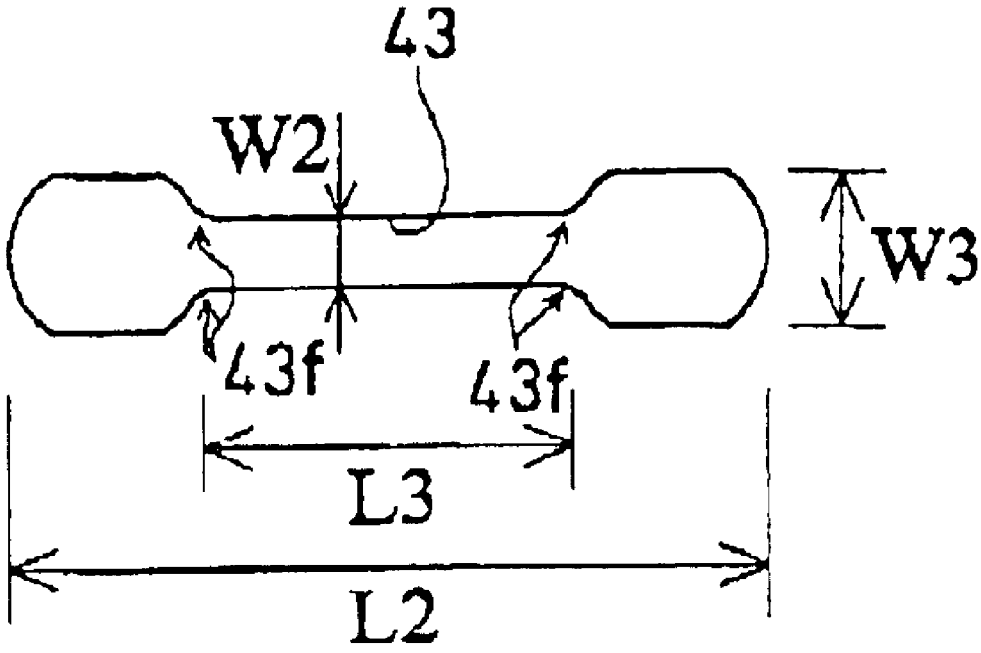
FIG. 14 is a plan view showing the detailed structure of the throttle portion.

As shown in FIGS. 12 and 14, the throttle portion 43 has a dumbbell-like shape narrowed at its lengthwise center portion. As a result, the throttle portions 43 is constructed so that a cross-sectional area S1 of the lengthwise center portion is made smaller than a cross-sectional area S2 of the passage at an end thereof connecting to the pressure chamber 36 through the ink supply hole 38 and a cross-sectional area S3 of the passage at an end thereof connecting to the common ink chamber 7 through the feed hole 44 (S2>S1 and S3>S1). It is to be noted here that the "cross-sectional area of the passage" means a sectional area orthogonal to the direction of elongation of the throttle portion 43 (a flowing direction of the ink).

The throttle portion 43 has, at a center thereof, the smallest cross-sectional area of the passage S1 (sectional area orthogonal to the flowing direction of the ink) in the ink passage extending from the common ink chamber 7 to the pressure chamber 36. From the viewpoint of the passage resistance, the passage resistance of the throttle portion 43 is the maximum in the ink passage extending from the common ink chamber 7 to the pressure chamber 36.

The throttling operation of the throttle portion causes the pressure wave, which is generated in the ink in the pressure chamber when the actuator 20 is driven, to be restricted against orienting toward the common ink chamber 7 and induces it to orient toward the nozzle 35 effectively. This enables the ink to be squirted from the nozzle with efficiency.

Since the throttle portion 43 is made larger in cross-sectional area of passage at the both end portions than at the center portion (S2>S1 and S3>S1), even when the three spacer plates 14X, 14Y and 14Z are somewhat out of position when laminated, communications between the feed holes 44 and the throttle portions 43 and between the throttle portions 43 and the ink supply holes 38 can be secured. In other words, since there is provided an increased allowable margin of error for the out-of-position in stuck, the yield of the passage unit can be increased and thus the production cost can be reduced.

In the illustrated embodiment, by making the throttle portion 43 larger in width at the both end portions (W3) than at the center portion (W2) (W3>W2), the relationship of the cross-sectional area of the passage (S2>S1 and S3>S1) is established.

In the illustrated embodiment, the upper spacer plate 14X (the fourth flat plate P4) is interposed between the intermediate spacer plate 14Y (the third flat plate P3) and the base plate 15 (the first flat plate P1), and the ink supply hole (communicating passage) 38 is formed to extend through the upper spacer plate 14X, as shown in FIGS. 9 and 12. The pressure chamber 36 and the throttle portion 43 are connected to each other via the ink supply hole 38. This produces the rational structure wherein the ink supply hole 38 is formed to extend through the upper spacer plate 14X serving to isolate the pressure chamber 36 and the throttle portion 43 from each other, thus providing a simplified structure of the passage extending from the common ink chamber 7 to the pressure chamber 36.

As shown in FIG. 13, when viewed from the thickness direction, one of the pressure chamber 36, the ink supply hole 38, and one end of the throttle portion 43 are overlapped with each other. In other words, when viewed from the direction of ink flow through the ink supply hole 38, three parts, i.e., the end portion of the pressure chamber 36 positioned upstream of the ink flow, the end portion of the throttle portion 43 positioned downstream of the ink flow, and the ink supply hole 38 are overlapped with each other. This can produce the rational passage arrangement to connect between the end of the pressure chamber 36 and the end of the throttle portion 43.

Further, in the illustrated embodiment, the lower spacer plate 14Z (the fifth flat plate P5) is interposed between the intermediate spacer plate 14Y (the third flat plate P3) and the manifold plates 13X, 13Y (the second flat plate P2), as shown in FIG. 9 and others. The lower spacer plate 14Z is provided with the feed holes (communicating passage) 44 to communicate between the common ink chamber 7 and the throttle portion 43. This produces the rational structure wherein the feed holes 44 are formed in the lower spacer plate 14Z, serving as the partition wall to isolate the throttle portion 43 and the common ink chamber 7 from each other, in such a manner as to extend through it, thus providing a simplified structure of the passage extending from the common ink chamber 7 to the pressure chamber 36.

In addition, in the illustrated embodiment, an area SB of an aperture of the ink feed hole 38 opening to an upstream end portion of the pressure chamber 36 is set to be smaller than a cross-sectional area of the pressure chamber (sectional area orthogonal to the flowing direction of the ink) SA (SB<SA), as shown in FIG. 12. This produces an increased resistance against the back-flow of the ink flowing from the pressure chamber 36 to the throttle portion 43, thus enabling the ink to be squirted at a higher speed.

Referring to FIG. 12, the relationship of a specific dimensional configuration will be described. Where t1 is the thickness of the base plate, and L1 and W1 are the length and width of the pressure chamber 36, respectively. Where t2 is the thickness of the intermediate spacer plate 14Y, the dimensional configuration is set at t2<t1. Also, where L2 is the whole length of the throttle portion 43, the dimensional configuration is set at L2<L1.

Referring now to FIG. 14, where L3 is the length of the throttle portion 43 at its part having the smallest cross-sectional area (where the cross-sectional area is S1 and the passage resistance is the maximum), the dimensional configuration is set at L3<L2. Where W2 is the width of the throttle portion 43 at its part having the smallest cross-sectional area, dimensional configuration is set at W2<W1. Further, Where W3 is the width of the throttle portion 43 at both lengthwise end parts thereof, dimensional configuration is set at W3>W2.

In the illustrated embodiment, the ink feed hole 38 is formed in the form of a columnar hole having a diameter D as shown in FIG. 12.

Figure 15:
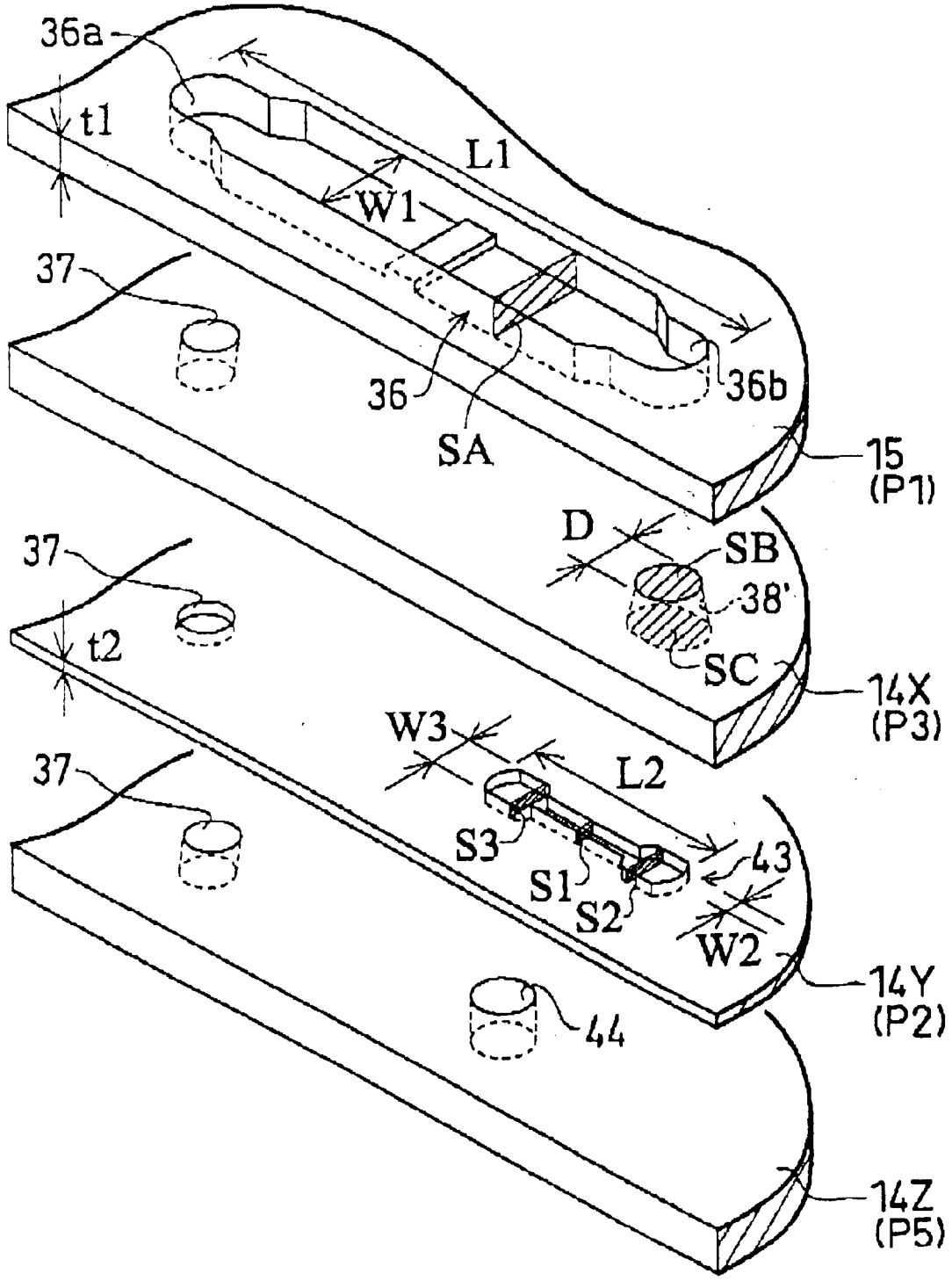
FIG. 15 is an exploded perspective view showing the details of the passage structure of the ink-jet head of a variant of the first embodiment.
Figure 16:
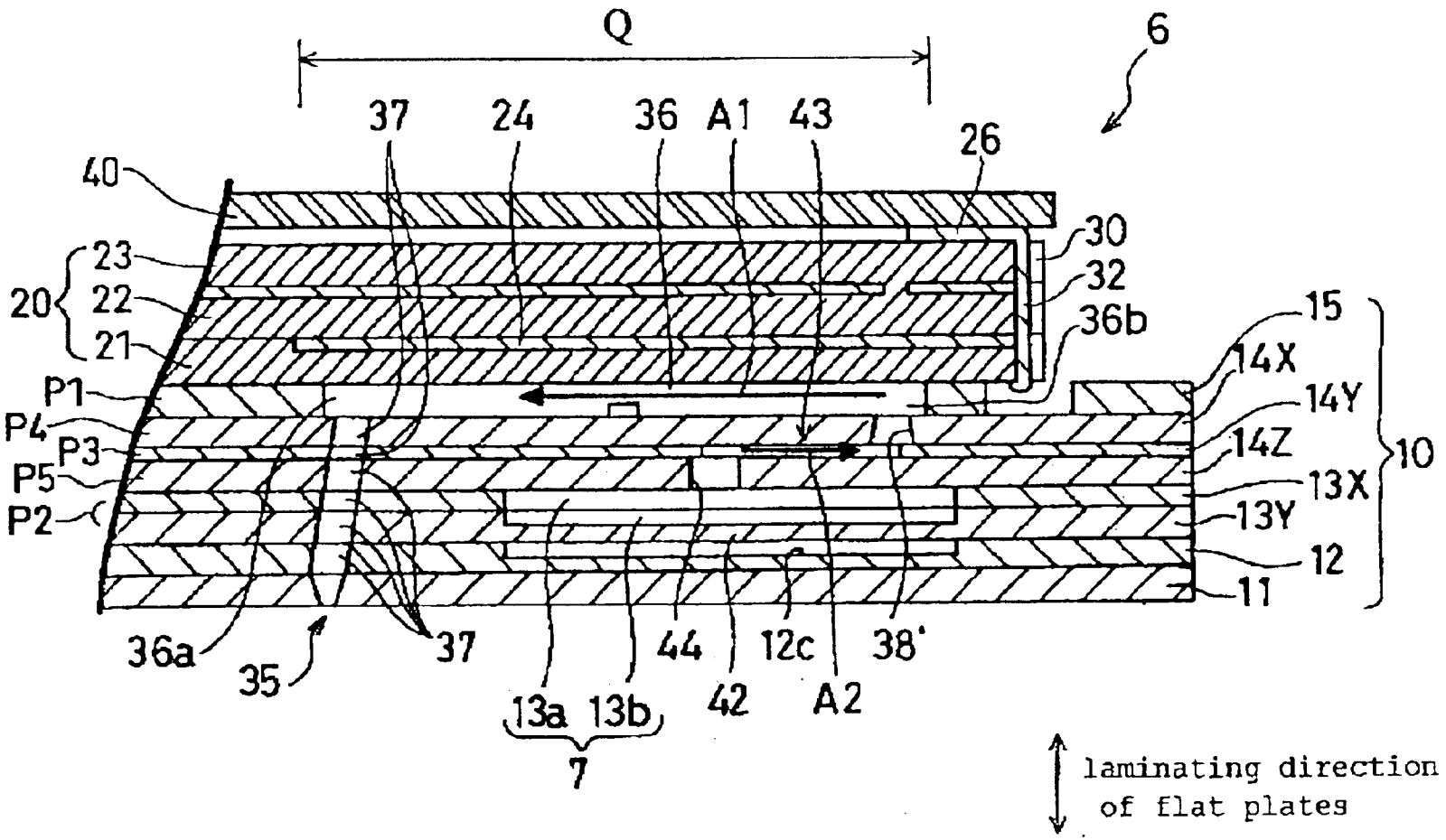
FIG. 16 is an enlarged cross-sectional view showing the passage structure of the ink-jet head of the variant of the first embodiment.

As shown in a variant of FIGS. 15, 16, the ink supply holes 38' may be presented in the form of a truncated-cone-shaped hole. In this variant, an area SB of an upper aperture of the ink supply hole 38' (on the side on which it communicates with the other end 36*b* of the pressure chamber 36) is set to be smaller than an area SC of a lower aperture of the same (on the side on which it communicates with one end of the throttle portion 43) (SB<SC), as shown in FIG. 15.

It is preferable that the area SB of the aperture of the ink supply hole 38 (38') opening to the pressure chamber 36 is made smaller than a cross-sectional area (SA=t1×W1) of the pressure chamber 35.

Experiments showed that where the width W1 of the pressure chamber 36 was about 250 μm and the ink supply hole 38' was a column-shaped hole having a diameter D=80 μm, the squirting speed of the ink from the nozzle 35 was approximately 8 m/s. When the ink supply hole 38 was increased in diameter D to 100 μm–120 μm, the ink squirting speed decreased to nearly to 7 m/s inversely as the diameter increased.

Similarly, it was found that where the width W1 of the pressure chamber 36 was about 250 μm and an aperture of the ink supply hole 38' on the pressure chamber 36 side was a circular hole having a diameter D=approximately 80 μm and an aperture of the same on the throttle portion 43 side was an oval hole of 120 μm×150 μm (an extending direction of its major axis is parallel with a longitudinal direction of the throttle portion 43), the squirting speed of the ink from the nozzle 35 was approximately 8 m/s. When the aperture of the ink supply hole 38' on the pressure chamber 36 side was increased in diameter D to 100 μm–120 μm, the ink squirting speed decreased to nearly to 7 m/s inversely as the diameter increased.

In the construction mentioned above, when the diameter D of the ink supply hole 38 (38') on the pressure chamber 36 side was reduced to ⅓ of the width W1 of the pressure chamber 36, to make the passage resistance of the ink supply hole 38 (38') smaller than that of the throttle portion 43, the good result that the ink squirting speed was increased was obtained.

This is probably due to the following reasons. When the pressure wave is generated in the pressure chamber 36 by the drive of the actuator 20, the ink is squirted toward the nozzle, while on the other hand, the reflective wave moves upstream of the ink flow and arrives at the ink supply hole 38' serving as a turning portion of the ink flow. Suppose that the area SB of the aperture of the ink supply hole 38 (38') is excessively large, the back-flow at the ink supply hole will be increased too much to decrease the ink squirting speed.

Thus, the ink speed squirting from the nozzle 35 can be increased by making the area SB of the aperture of the ink supply hole 38 (38') on the pressure chambers 36 side smaller than the cross-sectional area SA of the pressure chamber 36 to the greatest possible extent.

In the variant shown in FIGS. 15, 16, the area SB of the aperture of the ink supply hole 38' on the pressure chamber 36 side is set to be smaller than the area SC of the aperture of the same on the throttle portion 43 side. This can provide the result that even when it is difficult to form the columnar ink supply hole 38 in the upper spacer plate 14X (for example, when the diameter D smaller than the thickness t2 of the upper spacer plate 14X is required for reducing the area SB of the aperture), the area SB of the aperture of the ink supply hole 38' on the pressure chamber 36 side can be easily reduced to a desirable value by forming the ink supply hole 38' in a truncated cone shape, as in the variant.

In the variant shown in FIGS. 15, 16, due to the smaller area SB of the aperture on the pressure chamber 36 side (SB<SC), the ink flows at a faster speed of flow at the joint of the ink supply hole 38' to the pressure chamber 36 than at the joint of the ink supply hole 38' to the throttle portion 43. As a result, occurrence of stagnation of the ink at the end portion 36*b* of the pressure chamber 36 is avoided, so that the bubbles generated thereat are discharged with improved efficiency.

[Second Embodiment]

In the ink-jet head 6*p* of the second embodiment, the throttle portion is formed by using a so-called half etching technique, not to extend through the flat plate in the passing unit 10*p*.

A concrete description will be made of the second embodiment, with reference to FIG. 17. The manifold plates 13X, 13Y (the second flat plate P2) forming the common spacer plate 7 and the intermediate spacer plate 14Y' (the third flat plate P3') are laminated to be close to each other with no flat plate interposed therebetween. In other words, the lower spacer plate 14Z (the fifth flat plate P5) of the first embodiment is omitted from the construction of the second embodiment.

A surface of the intermediate spacer plate 14Y' of the third flat plate P3' confronting the pressure chamber 36 is subjected to the half etching, so that it is recessed in a grooved shape to form elongated throttle portion 43*p*. One end of the throttle portion 43*p* is connected to one end portion 36*b* of the pressure chamber 36 through the ink supply hole 38 formed in the upper spacer plate 14X to extend therethrough. The other end of the throttle portion 43*p* is connected to the common ink chamber 7 through the feed hole 44 formed in the intermediate spacer plate 14Y' to extend therethrough. The construction of the remaining parts is the same as that of the first embodiment.

Figure 17:
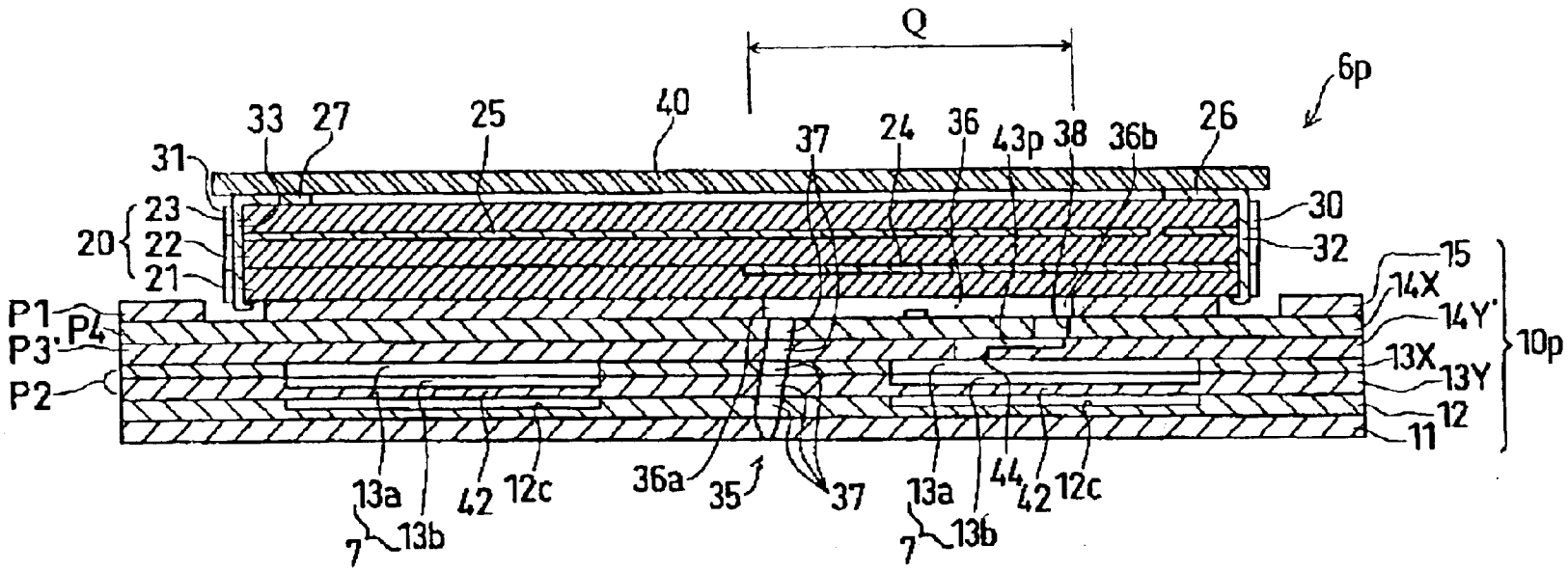
FIG. 17 is a cross-sectional view showing the passage structure of the ink-jet head of the second embodiment.

In the construction of FIG. 17 as well, the throttle portion 43*p* serving as the restricted passage is formed in the third flat plate P3' (the intermediate spacer plate 14Y') to extend long along a direction of a surface of the third flat plate P3' and also extend in a direction parallel with the plane formed by the pressure chamber 36. The direction of elongation of the throttle portion 43*p* is parallel with the longitudinal direction of the pressure chamber 36. The ink flows from the throttle portion 43*p* to the pressure chambers 36 through the ink supply hole 38, while U-turning. This can provide a compact passage structure to be contained in the space of a width Q and can also meet the demand for realization of a high-density passage arrangement accompanied by a high resolution of a picture and a compact ink-jet head.

Further, since the construction of the second embodiment can eliminate the need of the lower spacer plate 14Z, the component count, the production cost, and the production process can be reduced to that extent.

[Third Embodiment]

In the ink-jet head 6*q* of the third embodiment, the throttle portion is formed by using the half etching technique, not to extend through the flat plate in the passing unit 10*p*, in common with the second embodiment.

A concrete description will be made of the third embodiment, with reference to FIG. 18. The base plate 15 (the first flat plate P1) forming the pressure chamber 36 therein and the intermediate spacer plate 14Y' (the third flat plate P3") are laminated to be close to each other with no flat plate interposed therebetween. In other words, the upper spacer plate 14X (the fourth flat plate P4) of the first embodiment is omitted from the construction of the third embodiment.

A surface of the intermediate spacer plate 14Y' of the third flat plate P3' confronting the common ink chamber 7 is subjected to the half etching, so that it is recessed in a grooved shape to form elongated throttle portion 43*q*. One end of the throttle portion 43*q* is connected to one end portion 36*b* of the pressure chamber 36 through the ink supply hole 38 formed in the intermediate spacer plate 14Y to extend therethrough. The other end of the throttle portion 43*q* is connected to the common ink chamber 7 through the feed hole 44 formed in the lower spacer plate 14Z to extend therethrough. The construction of the remaining parts is the same as that of the first embodiment.

Figure 18:
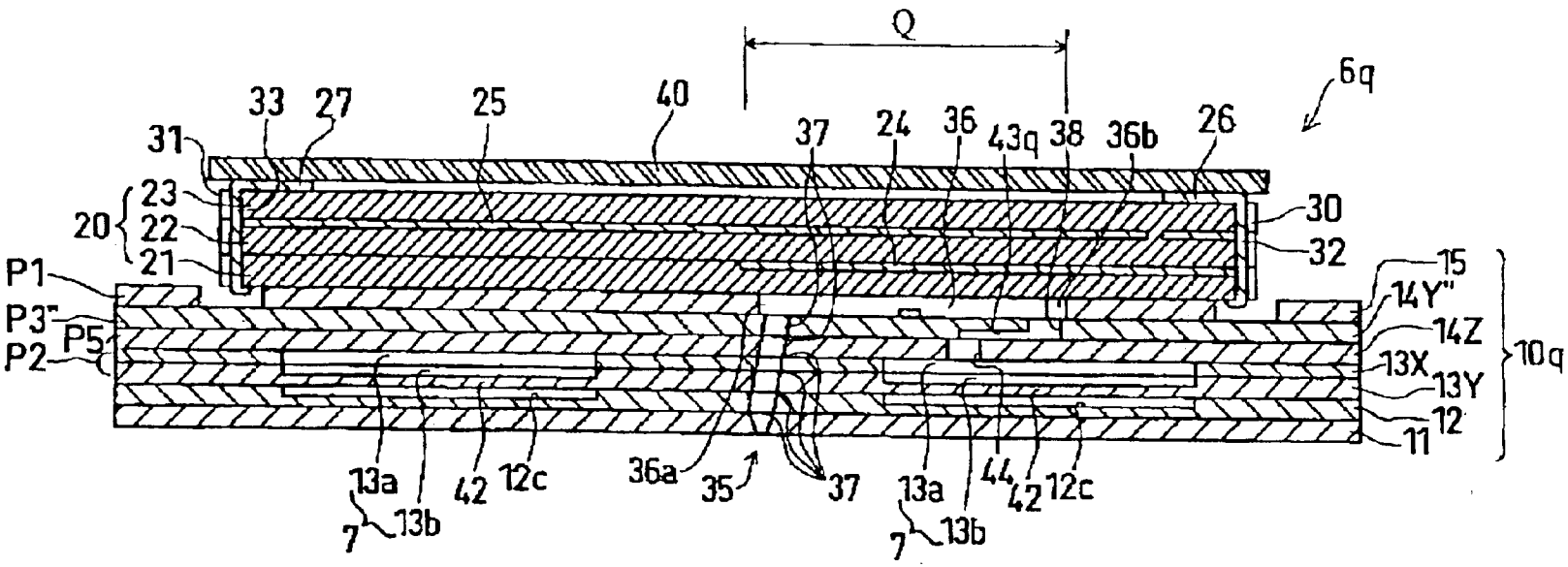
FIG. 18 is a cross-sectional view showing the passage structure of the ink-jet head of the third embodiment.

In the construction of FIG. 18 as well, the throttle portion 43*q* serving as the restricted passage is formed in the third flat plate P3" to extend long along a direction of a surface of the third flat plate P3" and also extend in a direction parallel with the plane formed by the pressure chamber 36. The direction of elongation of the throttle portion 43*q* is parallel with the longitudinal direction of the pressure chamber 36. The ink flows from the throttle portion 43*q* to the pressure chambers 36 through the ink supply hole 38, while U-turning. This can provide a compact passage structure to be contained in the space of a width Q and can also meet the demand for realization of a high-density passage arrangement accompanied by a high resolution of a picture and a compact ink-jet head.

Further, since the construction of the third embodiment can eliminate the need of the upper spacer plate 14X, the component count, the production cost, and the production process can be reduced to that extent.

[Fourth Embodiment]

The ink-jet head 6*r* of the fourth embodiment will be described with reference to FIG. 19. In this ink-jet head 6*r*, the ink supply hole 38*i* is formed in the upper spacer plate 14X' in the passage unit 10*r*. The ink supply hole 38*i* connects between one of the throttle portion 43 and the one end 36*b* of the pressure chamber 36. The ink flows from the throttle portion 43 to the pressure chamber 36 through the ink supply hole 38*i*. The pressure chamber 36 is formed in an elongated shape in a direction of an ink flowing through the pressure chamber 36 (in the direction indicated by an arrow A1). Also, the ink supply hole 38*i* is positioned upstream of the pressure chamber 36 with respect to the ink flowing direction.

In the fourth embodiment, the pressure chamber 36 corresponds to the first passage, and the ink supply hole 38*i* corresponds to the second passage. Also, the base plate 15 forming the pressure chamber 36 therein corresponds to the sixth flat plate P6, and the upper spacer plate 14X' forming the ink supply hole 38*i* therein corresponds to the seventh flat plate P7.

The base plate 15 and the upper spacer plate 14X' are laminated to be close to each other. The pressure chamber 36 and the ink supply hole 38*i* form a part of the ink passage extending from the common ink chamber 7 to the nozzle 35 through the pressure chamber 36.

The ink supply hole 38*i* is obliquely extended with respect to a laminating direction of the flat plates (a thickness direction of the flat plates) so that it can gradually approach an end wall 36*c* of the pressure chamber 36 at one lengthwise end 36*b* thereof in a downstream direction (toward the pressure chamber 36). In other words, the ink supply hole 38*i* is connected to the one lengthwise end 36*b* of the pressure chamber 36 at an angle smaller than 90°.

Figure 19:
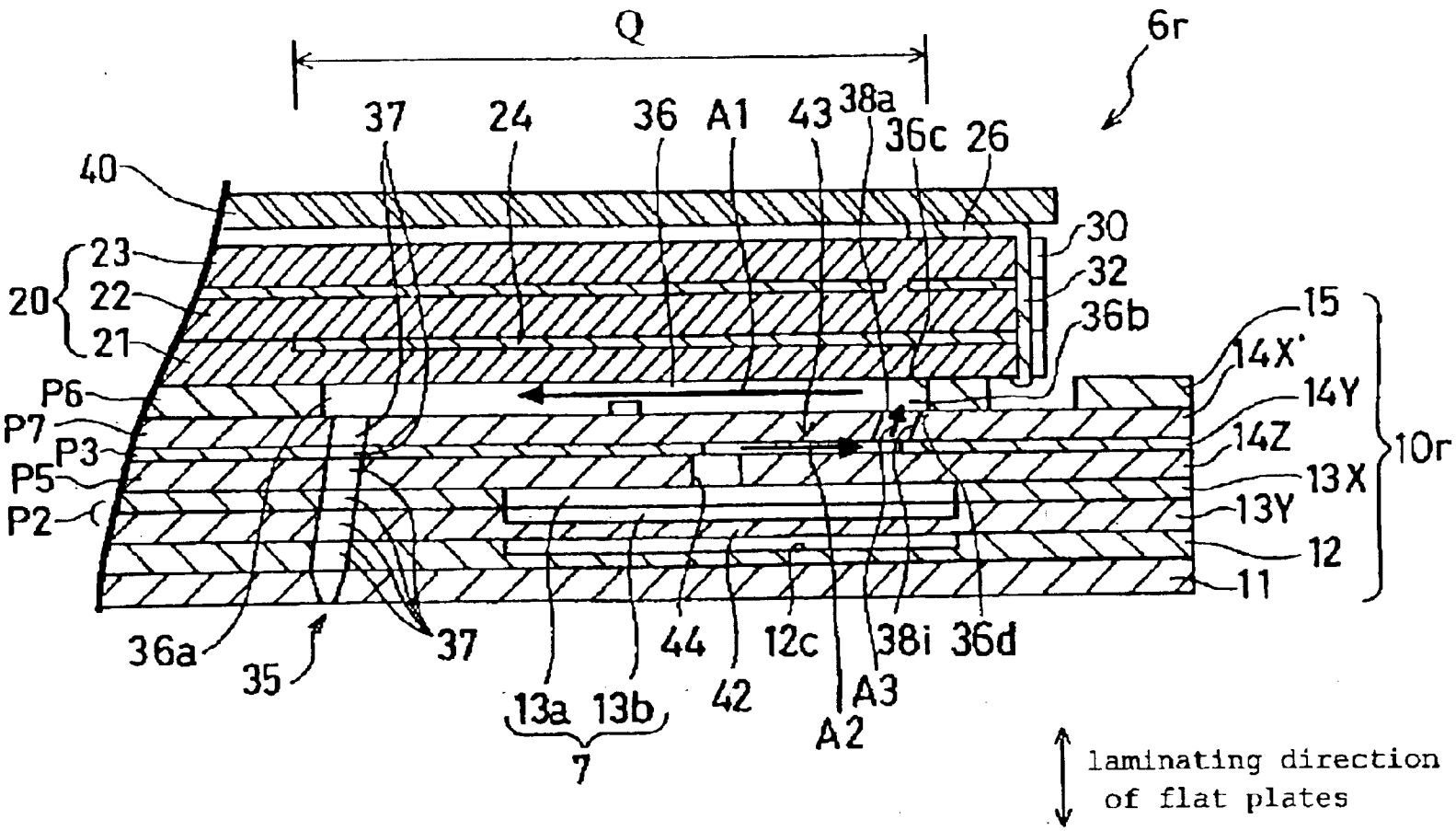
FIG. 19 is an enlarged cross-sectional view showing the passage structure of the ink-jet head of the fourth embodiment.

From the viewpoint of the ink flow, the direction A3 of the ink flowing through the ink supply hole 38*i* intersects with the direction A1 of the ink flowing through the pressure chamber 36 at an angle smaller than 90°, as shown in FIG. 19. This means that the ink flows while turning at an acute angle at a joint of the ink supply hole 38*i* to the pressure chamber 36. This can permit the ink to flow toward the end wall 36*c* immediately after it is fed to the pressure chamber 36 from the ink supply hole 38*i*.

The ink passage extending from the common ink chamber 7 to the nozzle 35 is required to ensure that the ink flows smoothly without stagnation to prevent accumulation of air bubbles in the passage and the air bubbles, if accumulated, can be easily purged by the purge mechanism 67. If the air bubbles are incompletely purged in the initial stage of the ink feed or if the air bubbles are generated in the ink and accumulated in the passage while growing in the printing operation, the ink will not be able to be squirted from the nozzle 35, to cause a blank in the printing surface (missing dot).

From this viewpoint, it is ideally desirable that a border of the aperture 38*a* of the ink supply hole 38*i* on the side confronting the pressure chamber 36 is substantially coincident with the end wall 35*c* of the pressure chamber 36. This is because, this construction can form no stepped portion at the joint of the ink supply hole 38*i* to the pressure chamber 36, so that the smooth ink flow is produced.

But, in fact, the border of the aperture 38*a* is often positioned inside of the end wall 36*c* of the pressure chamber 36 to avoid the overlapping with the end wall 36*c*. This can tolerate some out-of-position of the flat plates (the base plate 15, the upper spacer plate 14X') when laminated. Specifically, when the producing process is taken that after the pressure chamber 36 and the ink supply hole 38*i* are previously formed in two flat plates, respectively, the two flat plates are laminated together and thereby the first and second passages 36, 38*i* are both connected together, if the border of the aperture 38*a* is designed to be exactly coincident with the border of the end wall 35*c* of the pressure chamber 36, the following problem will be arisen. When the flat plates 15, 14' are out of position when laminated, the aperture 38*a* of the ink supply hole 38*i* is partly closed by the end wall 36*c*, and as such causes the passage resistance to increase, leading to variations in ink squirting property. In order to avoid this problem, the border of the aperture 38*a* is positioned inwardly from the border of the end wall 36*c*.

Figure 20:
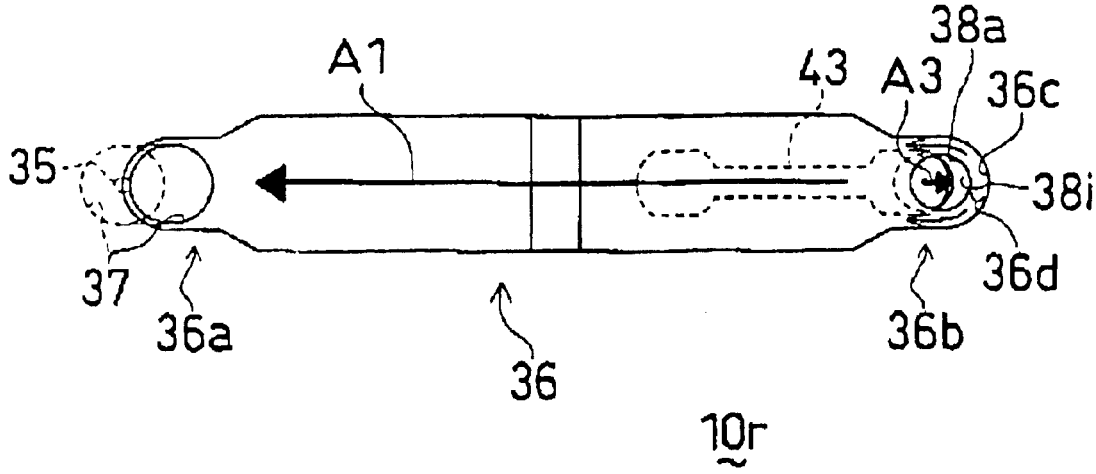
FIG. 20 is a plan view showing the ink flow at a connecting portion between an ink supply port and the pressure chamber in the ink-jet head of the fourth embodiment.

As a result, the stepped portion 36*d* is naturally produced between the edge of the aperture 38*a* and the end wall 36*c* at the joint of the ink supply hole 38*i* and the pressure chamber 36, as shown in FIGS. 19, 20. However, in this embodiment, since the ink supply hole 38*i* is obliquely extended so that it can gradually approach the end wall 36*c* in the downstream direction, as mentioned above, occurrence of the stagnation of the ink flow is prevented at the stepped portion 36*d*.

In other words, in this embodiment, the ink flow fed from the aperture 38*a* to the pressure chamber 36 is guided from substantially an opposite side to a flowing direction of the ink in the pressure chamber 36 toward the end wall 36*c* of the pressure chamber 36 at one lengthwise end portion 36*b* thereof, as shown in FIG. 20. This can produce the construction of difficult for air bubbles to accumulate at the stepped portion 36*d*. If accumulated, the air bubbles at the stepped portion 36*d* can be easily purged and discharged by the purging operation of the purge mechanism 67.

Figure 21:
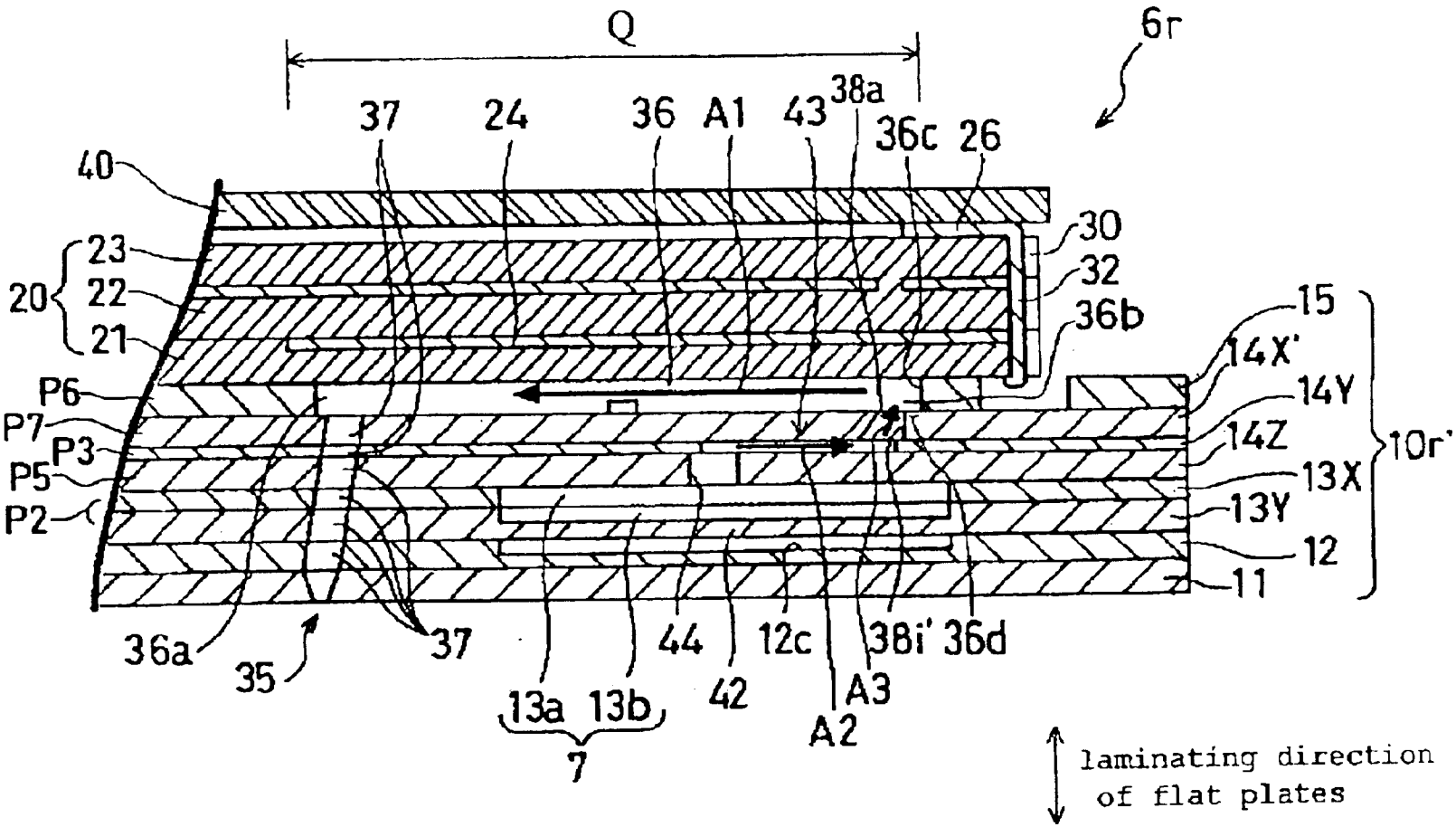
FIG. 21 is an enlarged cross-sectional view showing the passage structure of the ink-jet head of a variant of the fourth embodiment.

FIG. 21 shows a variant of the fourth embodiment. In this ink-jet head 6*r*', the ink supply hole 38*i*' is configured so that as the ink supply hole 38*i*' approaches the base plate 15 (the sixth flat plate P6), its across-sectional area can generally decrease to increase the passage resistance of the ink supply hole 38*i*'. Specifically, the ink supply hole 38*i*' is obliquely extended with respect to the laminating direction of the flat plates, as mentioned above, and also is tapered so that its downstream end can be narrowed. As a result, the ink flow in the ink supply hole 38*i* is increased in speed as it approaches the joint of the ink supply hole to the pressure chamber 36.

Accordingly, the ink flow squirting from the ink supply hole 38*i* to the pressure chamber 36 is increased in speed to purge the air bubbles at the stepped portions 36*d* with further efficiency. Thus, the purge of the air bubbles can be further facilitated.

In this embodiment, the pressure chamber 36 (the first passage) is formed in the base plate 15 (the sixth plate P6), and the ink supply hole 38*i* (the second passage) is formed in the upper spacer plate 14X' (the seventh flat plate P7). However, this is not limitative. Even when the pressure chamber 36 and the ink supply hole 38*i* are formed in the same flat plate, as long as the ink flows A3, A1 are formed, as shown in FIG. 19, the effect that the passage arrangement difficult for the air bubbles to accumulate and excellent in bubble purging can be obtained is not prevented.

While the first through fourth embodiments illustrated above use a single base plate 15 forming the pressure chamber 36 therein and two manifold plates 13X, 13Y forming the common ink chambers 7 therein, this is not limitative. For example, the pressure chamber may be formed to be extended between two flat plates or the common ink chamber may be formed in a single flat plate.

In addition to the illustrated actuator 20 of the type that provides the squirting pressure to the ink in the pressure chamber by using piezoelectricity or electrostriction deformation, those of different type that provide the squirting pressure to the ink by using a local boiling of the ink or equivalent by static electricity, magnetic energy and heating may be used.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a plurality of ink ejecting nozzles;

a first flat plate forming therein a plurality of pressure chambers communicating with their respective nozzles;

a second flat plate forming therein a common ink chamber to distribute and feed the ink to the pressure chambers; and a third flat plate interposed between the first flat plate and the second flat plate and forming therein a restricted passage to restrict an ink flow, one end of which is connected to the pressure chamber and the other end of which is connected to the common ink chamber, wherein the restricted passage is formed in the third flat plate, to be elongated along a direction of a surface of the third flat plate and is extended in a direction parallel with a plane formed by the pressure chambers.

2. The ink-jet head according to claim 1, wherein a direction of elongation of the restricted passage is parallel with a longitudinal direction of the pressure chambers.

3. The ink-jet head according to claim 2, wherein the ink flow in the restricted passage is oriented oppositely with respect to the ink flow in the pressure chambers.

4. The ink-jet head according to claim 2, wherein the ink flows from the restricted passage to the pressure chamber, while U-turning.

5. The ink-jet head according to claim 2, wherein the pressure chamber communicated with the restricted passage is positioned at one thickness side of the restricted passage and the common ink chamber is positioned at the other thickness side thereof.

6. The ink-jet head according to claim 2, wherein the restricted passage is at least partly overlapped with the pressure chamber, when viewed from the thickness direction of the flat plates.

7. The ink-jet head according to claim 2, wherein the restricted passage is shorter in length than the pressure chamber.

8. The ink-jet head according to claim 7, wherein the length of the restricted passage is included in the length of the pressure chamber, when viewed from the thickness direction of the flat plates.

9. The ink-jet head according to claim 1, wherein the restricted passage is formed to extend through the third flat plate in the thickness direction.

10. The ink-jet head according to claim 1, wherein the third flat plate is thinner than the first flat plate.

11. The ink-jet head according to claim 10, wherein the third flat plate is the thinnest of the flat plates forming therein an ink passage of the ink-jet head.

12. The ink-jet head according to claim 1, wherein a cross-sectional area of the restricted passage orthogonal to a direction of an ink flow is the smallest in an ink passage extending from the common ink chamber to the pressure chamber.

13. The ink-jet head according to claim 1, wherein a passage resistance of the restricted passage is the maximum in an ink passage extending from the common ink chamber to the pressure chamber.

14. The ink-jet head according to claim 1, wherein the restricted passage is smaller in cross-sectional area orthogonal to a direction of elongation of the restricted passage at both lengthwise end portions thereof than at a lengthwise center portion thereof.

15. The ink-jet head according to claim 1, wherein a fourth flat plate is interposed between the third flat plate and the first flat plate, and a communicating passage to communicate between the pressure chamber and the restricted passage is formed in the fourth flat plate.

16. The ink-jet head according to claim 15, wherein one end of the pressure chamber, the communicating passage, and one end of the restricted passage are overlapped with each other, when viewed from the thickness direction of the flat plates.

17. The ink-jet head according to claim 15, wherein the communicating passage is formed to extend through the fourth flat plate in the thickness direction, and an area of an aperture of the communicating passage opening to the restricted passage is smaller than an area of an aperture of the same opening to the pressure chamber.

18. The ink-jet head according to claim 15, wherein a fifth flat plate is interposed between the third flat plate and the second flat plate, and a communicating passage to communicate between the restricted passage and the common ink chamber is formed in the fifth flat plate.

19. The ink-jet head according to claim 1, wherein the restricted passage is formed in a grooved shape in the third flat plate, and a communicating passage to communicate between the pressure chamber and the restricted passage is formed in the third flat plate.

20. The ink-jet head according to claim 19, wherein one end of the pressure chamber, the communicating passage, and one end of the restricted passage are overlapped with each other, when viewed from the thickness direction of the flat plates.

21. The ink-jet head according to claim 19, wherein the third flat plate is positioned close to the first flat plate, and the restricted passage is formed in a surface of the third flat plate opposite to the first flat plate.

22. The ink-jet head according to claim 19, wherein the third flat plate is positioned close to the second flat plate, and the restricted passage is formed in a surface of the third flat plate opposite to the second flat plate.

23. The ink-jet head according to claim 19, wherein the communicating passage is formed to extend through the third flat plate in the thickness direction, and an area of an aperture of the communicating passage opening to the restricted passage is smaller than an area of an aperture of the same opening to the pressure chamber.

24. An ink-jet head comprising:

a plurality of ink ejecting nozzles;

a first flat plate forming therein a plurality of pressure chambers communicating with their respective nozzles;

a second flat plate forming therein a common ink chamber to distribute and feed the ink to the pressure chambers; and a third flat plate interposed between the first flat plate and the second flat plate and forming therein a restricted passage to restrict an ink flow, one end of which is connected to the pressure chamber and the other end of which is connected to the common ink chamber, wherein after the ink flows through the restricted passage along a direction of a surface of the third flat plate, it flows through the pressure chamber along a direction of a surface of the first flat plate.

25. The ink-jet head according to claim 24, wherein a passage resistance of the restricted passage is the largest in an ink passage extending from the common ink chamber to the pressure chamber.

26. The ink-jet head according to claim 24, wherein the ink flows from the restricted passage to the pressure chamber, while U-turning.

27. The ink-jet head according to claim 24, wherein the ink flow in the restricted passage is oriented parallel and oppositely with respect to the ink flow in the pressure chambers.

28. The ink-jet head according to claim 24, which further comprises:

a communicating passage; and a fourth flat plate having the communicating passage and interposed between the third flat plate and the first flat plate, and wherein after the ink flows through the restricted passage along a direction of a surface of the third flat plate, it flows through the pressure chamber along a direction of a surface of the first flat plate.

29. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises a first elongated passage, and a second passage positioned upstream of the first passage and connected to one lengthwise end portion of the first passage at an angle smaller than 90°.

30. The ink-jet head according to claim 29, wherein a cross-sectional area of the second passage gradually decreases as the second passage approaches the first passage.

31. The ink-jet head according to claim 29, wherein the second passage is configured to gradually increase its passage resistance as the second passage approaches the first passage.

32. The ink-jet head according to claim 29, wherein the first passage is formed by the pressure chambers, and the second passage forms at least a part of a passage communicating between the common ink chamber and the pressure chambers.

33. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises a first elongated passage and a second passage forming a part of the ink passage, the second passage being positioned upstream of the first passage and connected to one lengthwise end portion of the first passage, and wherein the ink flows while turning at an acute angle at a connecting portion between the second passage and the first passage.

34. The ink-jet head according to claim 32, wherein the ink flow in the second passage gradually increases in speed of flow as it approaches the connecting portion between the first passage and the second passage.

35. The ink-jet head according to claim 29, wherein the first passage is formed by the pressure chambers, and the second passage forms at least a part of a passage communicating between the common ink chamber and the pressure chambers.

36. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises a first elongated passage and a second passage forming a part of the ink passage, the second passage being positioned upstream of the first passage and connected to one lengthwise end portion of the first passage, and wherein the ink is obliquely guided at an angle of inclination from substantially an opposite side to a flowing direction of the ink in the first passage toward an end wall of the first passage at one lengthwise end portion thereof at a location where the second passage is connected to the first passage.

37. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises a first passage formed in a sixth flat plate and a second passage positioned upstream of the first passage and connected to one lengthwise end portion of the first passage, the second passage being formed in a seventh flat plate adjoining to the sixth flat plate, wherein an aperture defined by the second passage is formed in a surface of the seventh flat plate confronting the second flat plate and is positioned inside with respect to a wall of the first passage at one lengthwise end thereof so as not to be overlapped with the wall of the first passage, and wherein the second passage is obliquely extended with respect to a thickness direction of the flat plates so that it can gradually approach the wall of the first passage at one lengthwise end thereof in a downstream direction.

38. The ink-jet head according to claim 37, wherein a cross-sectional area of the second passage gradually decreases as the second passage approaches the first passage.

39. The ink-jet head according to claim 37, wherein the first passage is formed by the pressure chambers, and the second passage forms at least a part of a passage communicating between the common ink chamber and the pressure chambers.

40. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises:

a communicating passage opening to an upstream end of the pressure chamber; and a restricted passage extending in parallel with a direction of an ink flow in the pressure chamber, with one end thereof connected to the pressure chamber via the communicating passage and the other end thereof connected to the common ink chamber, wherein a passage resistance of the restricted passage is the maximum in the pressure chamber and an ink passage extending from the common ink chamber to the pressure chamber, and wherein an area of an aperture of the communicating passage opening to the pressure chamber is smaller than a cross-sectional area of the pressure chamber.

41. The ink-jet head according to claim 40, wherein the pressure chambers are formed in an elongated shape, and the communicating passage extends in a direction perpendicular to a longitudinal direction of the pressure chambers.

42. The ink-jet head according to claim 40, wherein an area of an aperture of the communicating passage opening to the pressure chamber is smaller than an area of an aperture of the same opening to the restricted passage.

43. The ink-jet head according to claim 40, wherein an ink flow passing through a location where the communicating passage and the pressure chamber are connected with each other is larger in speed of flow than an ink flow passing through a location where the restricted passage and the communicating passage are connected with each other.

44. An ink-jet head comprising:

a plurality of ink ejecting nozzles;

a plurality of pressure chambers communicating with their respective nozzles;

a common ink chamber to distribute and feed the ink to the pressure chambers; and an ink passage extending from the common ink chamber to the nozzle through the pressure chamber, wherein the ink passage comprises:

a communicating passage opening to an upstream end of the pressure chamber; and a restricted passage extending in parallel with a direction of an ink flow in the pressure chamber, with one end thereof connected to the pressure chamber via the communicating passage and the other end thereof connected to the common ink chamber, wherein a cross-sectional area of the restricted passage orthogonal to a direction of an ink flow is the smallest in the pressure chamber and an ink passage extending from the common ink chamber to the pressure chamber, and wherein an area of an aperture of the communicating passage opening to the pressure chamber is smaller than a cross-sectional area of the pressure chamber.

45. The ink-jet head according to claim 44, wherein the pressure chambers are formed in an elongated shape, and the communicating passage extends in a direction perpendicular to a longitudinal direction of the pressure chambers.

46. The ink-jet head according to claim 44, wherein an extending direction of the pressure chambers and an extending direction of the restricted passage are parallel with each other.

47. The ink-jet head according to claim 46, wherein when viewed from the direction of the ink flow in the communicating passage, three parts, i.e., an upstream end portion of the pressure chamber with respect to the direction of the ink flow, a downstream end portion of the restricted passage with respect to the direction of the ink flow, and the communicating passage are arranged in such a relation as to be overlapped with each other.

48. The ink-jet head according to claim 46, wherein the restricted passage is shorter in length than the pressure chambers.

49. The ink-jet head according to claim 46, wherein when viewed from the direction of the ink flow in the communicating passage, a length of the restricted passage is included in a length of the pressure chambers.

50. The ink-jet head according to claim 46, wherein the ink flows from the restricted passage to the pressure chamber, while U-turning.

* * * * *